US006615772B2

(12) United States Patent
Ichinose et al.

(10) Patent No.: US 6,615,772 B2
(45) Date of Patent: Sep. 9, 2003

(54) INTERNAL COMBUSTION ENGINE WITH HEAT ACCUMULATING DEVICE AND METHOD OF CONTROLLING SAME

(75) Inventors: Hiroki Ichinose, Fujinomiya (JP); Takayuki Otsuka, Susono (JP); Hideo Kobayashi, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/167,425

(22) Filed: Jun. 13, 2002

(65) Prior Publication Data

US 2002/0195068 A1 Dec. 26, 2002

(30) Foreign Application Priority Data

Jun. 25, 2001 (JP) ..... 2001-191361

(51) Int. Cl.[7] ..... F01P 11/02
(52) U.S. Cl. ..... 123/41.14; 123/142.5 R
(58) Field of Search ..... 123/41.14, 142.5 R

(56) References Cited

FOREIGN PATENT DOCUMENTS

JP A 6-213117 8/1994

*Primary Examiner*—Noah P. Kamen
(74) *Attorney, Agent, or Firm*—Oliff & Berridge, PLC

(57) ABSTRACT

An engine system that includes an internal combustion engine and a heat accumulating device also includes a heat accumulator that accumulates heat by storing a heated cooling medium, a heat supplying device that supplies the cooling medium accumulated in the heat accumulating device to the engine, a cooling medium temperature detector that measures the temperature of the cooling medium, and a controller that carries out failure determination of the heat accumulating device according to various techniques.

40 Claims, 17 Drawing Sheets

INTERNAL COMBUSTION ENGINE WITH HEAT ACCUMULATING DEVICE AND METHOD OF CONTROLLING SAME

INCORPORATION BY REFERENCE

The disclosure of Japanese Patent Application No. 2001-191361 filed on Jun. 25, 2001 including the specification, drawings and abstract is incorporated herein by reference in its entirety.

BACKGROUND OF THE INVENTION

1. Field of Invention

The present invention relates to an internal combustion engine having a heat accumulating device and to methods of controlling same.

2. Description of Related Art

Generally, when an internal combustion engine is running under conditions in which the temperature around combustion chambers is below a predetermined temperature, in other words, running under cold conditions there can be difficulty atomizing fuel supplied to the combustion chambers, and quenching around walls of the combustion chambers occurs. Therefore, deterioration in exhaust gas emission and starting performance are induced.

In order to obviate the above-mentioned problems, an internal combustion engine with a heat accumulating device capable of accumulating heat generated by the engine during its running (operation) has been developed. The accumulated heat from the heat accumulating device is supplied to the engine when the engine is at rest or when the engine is started. However, to achieve improvement in emission performance and mileage immediately after the engine is started, it is preferable that the engine reach or exceed a predetermined temperature when it is started, and that it be supplied with the heat before it is started.

The emission performance of the internal combustion engine with the above-described accumulating device depends greatly on whether an insulation function of the heat accumulating device is normal or not. Therefore, a technique for detecting deterioration in the emission performance has been developed.

According to Japanese Patent Laid-Open Publication No. 6-213117, a temperature detecting sensor is provided in a heat accumulator of a heat accumulating device, and a temperature indicating panel in a compartment indicates the detected temperature, so that the temperature in the heat accumulator can be known.

The temperature in the heat accumulator, for example, typically is around 75° C. twelve hours after an internal combustion engine is stopped, and around 80° C. to 90° C. when the engine is running under normal conditions. If the temperature indicated by the temperature indicating panel is around the above-mentioned temperature when the engine is started, this indicates that the temperature of water coolant, which has been accumulated in the heat accumulator, has been kept high. This indicates that the insulation function of the heat accumulating device is normal. If the temperature indicated by the temperature indicating panel is extremely lower than the above-mentioned temperature, on the other hand, this indicates that an abnormality in the insulation function of the heat accumulator in the heat accumulating device may exist.

According to an internal combustion engine with the above-described heat accumulating device, an abnormality in the insulation function is detected based on the assumption that water coolant is accumulated in the heat accumulator in conditions where the engine has sufficiently been warmed up. Therefore, the temperature indicating panel indicates a low temperature if the engine is stopped immediately after the engine is started, i.e., before the water coolant temperature rises sufficiently. It is difficult to distinguish this case from the case where the temperature in the heat accumulator in the heat accumulating device drops because of an abnormality in the insulation function.

In addition, if the coolant is circulated into the engine when the engine is at rest, a low-temperature coolant may flow into the heat accumulating device from the engine. As a result, the temperature indicated by the temperature indicating panel drops. It is also difficult to distinguish this case from the case where the temperature in the heat accumulator in the heat accumulating device drops because of an abnormality in the insulation function.

Furthermore, when an abnormality in a circulation channel for circulating a cooling medium is generated, confirming the abnormality is not possible.

SUMMARY OF THE INVENTION

The present invention has been achieved to address the above-mentioned problems, and one object is to allow for the carrying out of a failure determination of a heat accumulating device according to the temperature of a cooling medium in an internal combustion engine having the heat accumulating device.

A first aspect of the invention relates to an engine having a heat accumulating device including a heat accumulator that accumulates heat by storing a heated cooling medium, a heat supplying device for supplying the cooling medium accumulated in the heat accumulator to the engine, and a cooling medium temperature detector that measures the temperature of the cooling medium. The engine further includes a controller that carries out the failure determination of the heat accumulating device according to a variation of values measured by the cooling medium temperature detector when the heat is being supplied by the heat supplying device. According to this aspect of the invention, the failure determination of the heat accumulating device is carried out according to temperature variation in the heat accumulator when the heat is being supplied from the accumulator.

In the internal combustion engine having the heat accumulating device as described above, heat generated during running of the engine can be accumulated by the heat accumulator even after the engine is turned off. The heat accumulated by the heat accumulator can be supplied to the engine through the cooling medium when the engine is started under cold conditions. If the heat is supplied as described above, the engine is warmed up rapidly even when the engine is started under cold conditions.

Meanwhile, if an insulating function of the heat accumulator deteriorates, the temperature of the cooling medium in the heat accumulator drops. As a result, the engine cannot be warmed up by circulating the cooling medium in the engine. Furthermore, if there is an abnormality in the heat accumulator, the engine cannot be warmed up quickly since circulation of the cooling medium is stopped. Under the above-described condition, the temperature measured by the cooling medium temperature detector becomes approximately constant.

Therefore, in the internal combustion engine with the heat accumulating device according to this aspect of the invention, the failure of the heat accumulating device can be determined according to the value measured by the cooling medium temperature detector when the heat is supplied from the accumulator.

A second aspect of the invention related to an engine having a heat accumulating device including a heat accumulator for accumulating heat by storing a heated cooling medium, a heat supplying device for supplying the cooling medium accumulated in the heat accumulator to the engine, an in-heat accumulator detector that measures the temperature of the cooling medium in the heat accumulator, and an in-engine temperature detector that measures the temperature of the cooling medium in the engine. The engine further includes a controller that carries out the failure determination of the heat accumulating device according to whether there is a difference between a value measured by the in-heat accumulator temperature detector and the value measured by the in-engine temperature detector when the heat is being supplied by the heat supplying device or before the heat is supplied therefrom. According to this aspect of the invention, the failure determination of the heat accumulating device is carried out according to whether there is a difference between the value measured by the in-heat accumulator temperature detector and the value measured by the in-engine temperature detector.

In the internal combustion engine having the heat accumulating device as described above, heat generated during running of the engine can be accumulated by the heat accumulator even after the engine is turned off. The heat accumulated by the heat accumulator can be supplied to the engine through the cooling medium when the engine is started under cold conditions. If the heat is supplied as described above, the engine is warmed up rapidly even when the engine is started under cold conditions. When the heat supply is completed, the temperatures of the cooling medium in the heat accumulator and the engine become approximately the same.

Meanwhile, if there is an abnormality in the heat supplying device, the engine is not warmed up, and the heat accumulator keeps storing the heat. At this time, the difference between the temperature in the heat accumulator and that in the engine does not change or it changes a little, if any.

Therefore, in the internal combustion engine having the heat accumulating device according to this aspect of the invention, the failure of the heat accumulating device can be determined according to the difference between the temperature in the heat accumulator and that in the engine when the heat is supplied from the accumulator.

A third aspect of the invention relates to a heat accumulating device including a heat accumulator that accumulates heat by storing a heated cooling medium, a heat supplying device that supplies the cooling medium accumulated in the heat accumulator to the engine, an in-heat accumulator temperature detector that measures the temperature of the cooling medium in the heat accumulator, and an in-engine temperature detector that measures the temperature of the cooling medium in the engine. The engine further includes a controller that carries out the failure determination of the heat accumulating device according to a difference between a value measured by the in-heat accumulator temperature detector and one by the in-engine temperature detector when a predetermined time elapses after the engine is turned off. According to this aspect of the invention, the failure determination of the heat accumulating device is carried out according to whether there is a difference between the value measured by the in-heat accumulator temperature detector and that by the in-engine temperature detector when the predetermined time elapses after the engine is turned off.

A fourth aspect of the invention relates to an engine having a heat accumulating device including a heat accumulator that accumulates heat by storing a heated cooling medium, a heat supplying device that supplies the cooling medium accumulated in the heat accumulator to the engine, and a cooling medium heater that automatically heats the cooling medium in the heat accumulator to keep the temperature of the cooling medium equal to or higher than a predetermined temperature. The engine further includes a controller that carries out the failure determination of the heat accumulating device according to a driving history of the cooling medium heater when a predetermined time elapses after the engine is turned off. According to this aspect of the invention, the failure determination of the heat accumulating device is carried out according to the driving history of the cooling medium heater when the predetermined time elapses after the engine is turned off.

In the internal combustion engine having the heat accumulating device as described above, heat generated during running of the engine can be accumulated by the heat accumulator even after the engine is turned off. The heat accumulated by the heat accumulator can be supplied to the engine through the cooling medium when the engine is started under cold conditions. If the heat is supplied as described above, the engine is warmed up rapidly even when the engine is started under cold conditions. When the heat supply is completed, the temperatures of the cooling medium in the heat accumulator and the engine become approximately the same.

Meanwhile, a small amount of heat is emitted out of the heat accumulator, so that the temperature in the heat accumulator drops. To compensate for the emitted heat, the cooling medium heater is provided to heat the cooling medium. If the insulation performance of the heat accumulator is not deteriorating, the amount of heat emitted out of the heat accumulator is small, so that the amount of heat applied to the cooling medium by the cooling medium heater is also small. However, if the insulation performance of the heat accumulator deteriorates, the amount of heat emitted out of the heat accumulator becomes larger, so that the amount of heat applied to the cooling medium by the cooling medium heater also becomes larger.

Therefore, in the internal combustion engine having the heat accumulating device according to this aspect of the invention, the controller can determine a failure of the heat accumulating device according to the driving history of the cooling medium heater.

A fifth aspect of the invention relates to an engine having a heat accumulating device including a heat accumulator that accumulates heat by storing a heated cooling medium, a heat supplying device that supplies the cooling medium accumulated in the heat accumulator to the engine, a cooling medium heater that automatically heats the cooling medium in the heat accumulator to keep the temperature of the cooling medium equal to or higher than a predetermined temperature, and an in-heat accumulator temperature detector that measures the temperature of the cooling medium in the heat accumulator. The engine further includes a controller that carries out the failure determination of the heat accumulating device according to a measuring result by the in-heat accumulator temperature detector when a predetermined time elapses after the engine is turned off. According to this aspect of the invention, the failure determination of the heat accumulating device is carried out according to a measuring result by the in-heat accumulator temperature detector when the predetermined time elapses after the engine is turned off.

In the internal combustion engine having the heat accumulating device as described above, heat generated during running of the engine can be accumulated by the heat accumulator even after the engine is turned off. The heat accumulated by the heat accumulator can be supplied to the engine through the cooling medium when the engine is started under cold conditions. If the heat is supplied as described above, the engine is warmed up rapidly even when the engine is started under cold conditions. When the heat supply is completed, the temperatures of the cooling medium in the heat accumulator and the engine become approximately the same.

Meanwhile, as described above, a small amount of heat is emitted out of the heat accumulator, so that the temperature in the heat accumulator drops. To compensate for the emitted heat, the cooling medium heater is provided to heat the cooling medium. If the insulation performance of the heat accumulator is not deteriorating, the amount of heat emitted out of the heat accumulator is small, so that the amount of heat applied to the cooling medium by the cooling medium heater is also small. However, if the insulation performance of the heat accumulator deteriorates, the amount of heat emitted out of the heat accumulator becomes larger, so that the amount of heat applied to the cooling medium by the cooling medium heater also becomes larger. At this time, if the amount of the heat emitted out of the heat accumulator is larger than the amount of heat supplied by the cooling medium heater, the temperature of the cooling medium in the heat accumulator drops. Furthermore, the temperature of the cooling medium in the heat accumulator also drops if there is a failure of the cooling medium heater.

Therefore, in the internal combustion engine having the heat accumulating device according to this aspect of the invention, the controller can determine a failure of the heat accumulating device according to a measuring result by the in-heat accumulator temperature detector when the predetermined time elapses after the engine is turned off.

BRIEF DESCRIPTION OF THE DRAWINGS

The above and other objects, features, advantages, technical and industrial significance of this invention will be better understood by reading the following detailed description of exemplary embodiments of the invention, when considered in connection with the accompanying drawings, in which.

DETAILED DESCRIPTION OF EXEMPLARY EMBODIMENTS

The following explains in detail exemplary embodiments of a heat accumulating device of an internal combustion engine relating to the invention according to the drawings mentioned above. This part explains a heat accumulating device of an internal combustion engine relating to the invention by giving examples of applying a heat accumulating device to a gasoline engine for driving a vehicle. The invention is not limited to gasoline engines, but applies to any engine (or system having an engine) where it would be helpful to provide a heat accumulator either to help warm-up the engine or otherwise provide a source of heat (e.g., to an internal passenger compartment of the vehicle) when the usual source of heat is not available.

The First Exemplary Embodiment

Figure 1:
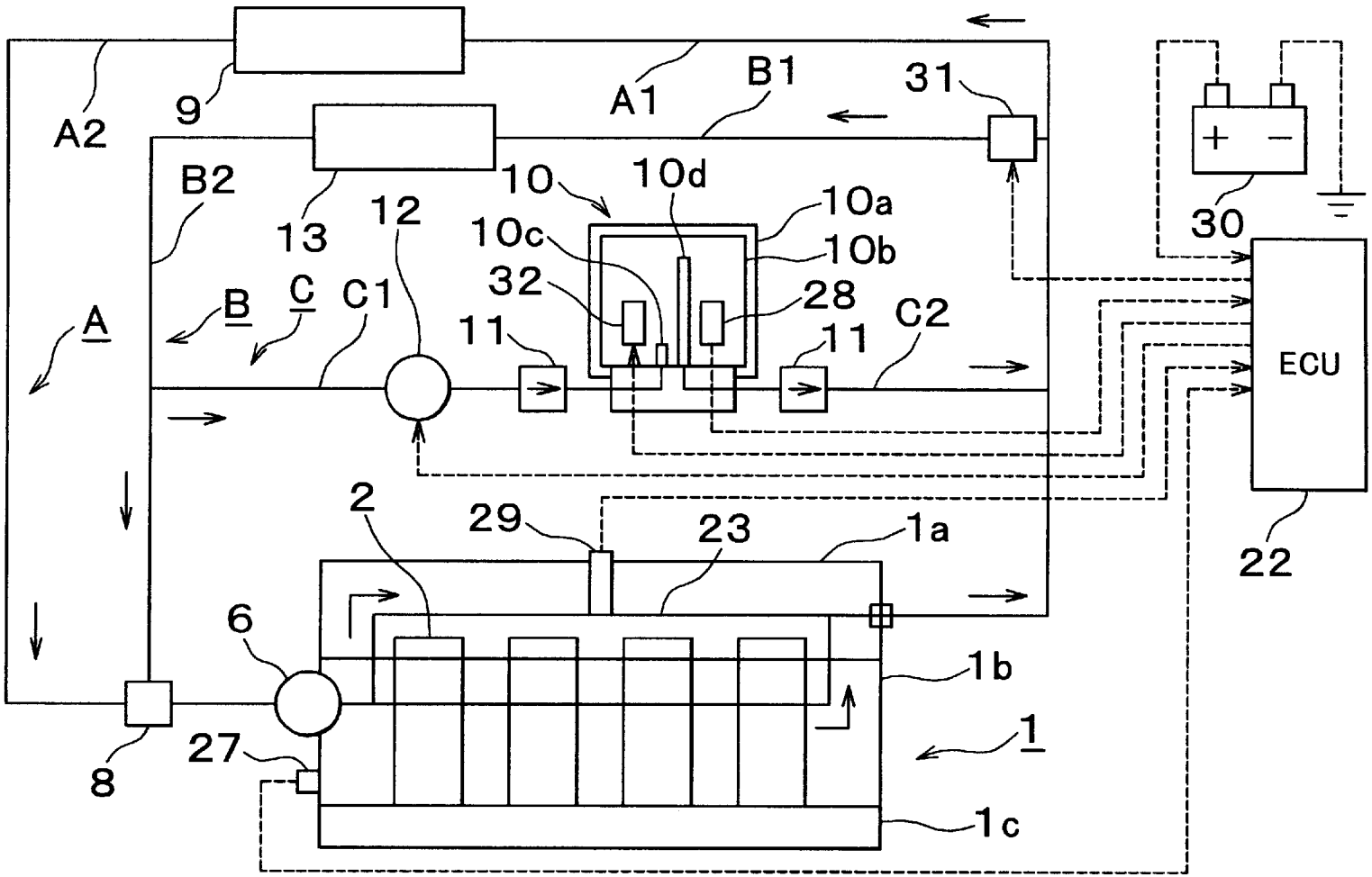
FIG. 1 is a schematic view showing an engine that includes a heat accumulating device and water coolant channels in which water coolant for the engine circulates according to exemplary embodiments of the invention.

FIG. 1 is a schematic view showing an engine 1 having a heat accumulating device relating to the invention, and water coolant channels A, B, and C (circulation channels). The arrows by the circulation channels indicate the flowing directions of water coolant during running of the engine 1.

The engine 1 shown in FIG. 1 is a water-cooled, 4-cycle, gasoline engine. The engine 1 may be 6-cycle engine or an engine with other number of cycles. Furthermore, the engine 1 may be an internal combustion engine such as a diesel engine rather than a gasoline engine.

The exterior part of engine 1 includes a cylinder head 1*a*, cylinder block 1*b* connected to the lower part of the cylinder head 1*a*, and an oil pan 1*c* connected to the lower part of the cylinder block 1*b*.

The cylinder head 1*a* and the cylinder block 1*b* are provided with a water jacket 23, through which water coolant circulates. A water pump 6, which sucks in water coolant from outside the engine 1 and discharges the water coolant into the engine 1, is provided at an inlet of the water jacket 23. The water pump 6 is driven by torque from an output shaft of the engine 1. In other words, the water pump 6 can only be driven during running of the engine 1. In addition, an in-engine water coolant temperature sensor 29, which transmits signals according to the water coolant temperature in the water jacket 23, is attached at the engine 1.

There are three circulation channels as channels to circulate the water coolant through the engine 1: a circulation channel A, which circulates through a radiator 9, a circulation channel B, which circulates through a heater core 13, and a circulation channel C, which circulates through a heat accumulator 10. A portion of each circulation channel is shared by another one of the circulation channels.

The circulation channel A has the main function of lowering the water coolant temperature by emitting heat of the water coolant from the radiator 9.

The circulation channel A includes a radiator inlet-side channel A1, a radiator outlet-side channel A2, the radiator 9, and the water jacket 23. One end of the radiator inlet-side channel A1 is connected to the cylinder head 1*a*. The other end of the radiator inlet-side channel A1 is connected to the inlet of the radiator 9.

One end of the radiator outlet-side channel A2 is connected to the outlet of the radiator 9. The other end of the radiator outlet-side channel A2 is connected to the cylinder block 1*b*. A thermostat 8 is provided on the radiator outlet-side channel A2 from the outlet of the radiator 9 to the cylinder block 1*b*. The thermostat 8 has the function of opening its valve when the water coolant reaches a predetermined temperature. In addition, the radiator outlet-side channel A2 is connected with the cylinder block 1*b* through the water pump 6.

The circulation channel B has the main function of raising an ambient temperature in a (passenger) compartment of a vehicle by emitting heat of the water coolant from the heater core 13.

The circulation channel B includes a heater core inlet-side channel B1, a heater core outlet-side channel B2, the heater core 13, and the water jacket 23. One end of the heater core inlet-side channel B1 is connected to a point midway of the radiator inlet-side channel A1. Thus, a channel from the cylinder head 1*a* to the connection described above, which is a part of the heater core inlet-side channel B1, is shared by the radiator inlet-side channel A1. The other end of the heater core inlet-side channel B1 is connected to the inlet of the heater core 13. A shut-off valve 31, which is opened and closed by signals from an Electronic Control Unit (ECU) 22, is located midway of the heater core inlet-side channel B1. One end of the heater core outlet-side channel B2 is connected to the outlet of the heater core 13. The other end of the heater core outlet-side channel B2 is connected to the thermostat 8, which is located midway of the radiator outlet-side channel A2. Thus, the water pump 23 and a channel from the connection described above to the cylinder block 1*b* are shared by the radiator outlet-side channel A2.

The circulation channel C has the main function of heating the engine 1 by accumulating heat of the water coolant and emitting the accumulated heat.

The circulation channel C includes a heat accumulator inlet-side channel C1, a heat accumulator outlet-side channel C2, the heat accumulator 10, and the water jacket 23. One end of the heat accumulator inlet-side channel C1 is connected to a point midway of the heater core outlet-side channel B2. Thus, a channel from the cylinder head 1*a* to the connection described above is shared by the circulation channels B and C. On the other hand, the other end of the heat accumulator inlet-side channel C1 is connected to the inlet of the heat accumulator 10. One end of the heat accumulator outlet-side channel C2 is connected to the outlet of the heat accumulator 10. The other end of the heat accumulator outlet-side channel C2 is connected to a point midway of the radiator inlet-side channel A1. Thus, sections of the circulation channel A, the circulation channel B, and the water jacket 23 are shared by the circulation channel C in the engine 1. In addition, reverse flow-preventing valves (one-way valves) 11, which allow flow of the water coolant only in the direction shown in FIG. 1, are located at the inlet and outlet of the heat accumulator 10. An in-heat accumulator water coolant temperature sensor 28, which transmits signals according to the temperature of the water coolant accumulated in the heat accumulator, is provided in the heat accumulator 10. Furthermore, a motor-driven water pump 12 (i.e., pump 12 is driven by an electric motor, not by the engine 1) is located midway of the heat accumulator inlet-side channel C1 and upstream the reverse flow-preventing valve 11.

The heat accumulator 10 is provided with an evacuated, heat-insulating space between an exterior container 10*a* and an interior container 10*b*. A water coolant injecting tube 10*c*, a water coolant extracting tube 10*d*, a heater 32, and the above-mentioned in-heat accumulator water coolant temperature sensor 28 are provided in the heat accumulator 10. The water coolant passes through the water coolant injecting tube 10*c* when it flows into the heat accumulator 10, and it passes through the water coolant extracting tube 10*d* when it flows out of the heat accumulator 10.

The heater 32 heats the water coolant accumulated in the heat accumulator 10 when the water coolant temperature drops below a predetermined temperature. A positive temperature coefficient thermistor (PTC thermistor hereafter), which is formed by adding an additive to barium titanate, is incorporated in the heater 32. The PTC thermistor is a thermal, resistive element whose resistance rises rapidly when it reaches a predetermined temperature (Curie Temperature). When the element, which has been heated with applied voltage, reaches the Curie temperature, the temperature of the element drops since its resistance increases and its electrical conductivity decreases. As a result of the drop in temperature, the resistance decreases, and the electrical conductivity increases, so that the temperature rises. As described above, the PTC thermistor can control its temperature to an approximately constant value by itself, so that it is not necessary to control the temperature from outside.

With the above-described heater 32 being provided, a heat function of the heat accumulator 10 can be retained for a long period of time since the water coolant, whose temperature has dropped because of its circulation, can be heated again. According to the present embodiment, the heater 32 is not constantly supplied with electric power, but the electric power supply is controlled by a CPU 351.

The heat accumulator 10 and the parts that make-up a heat supplying device: the water pump 12, the reverse flow-preventing valves 11, the heat accumulating device inlet-side channel C1, and the heat accumulating device outlet-side channel C2, the heater 32, etc. are referred to as a heat accumulating device in a general sense.

Torque from a crankshaft (not shown) of the engine is transmitted to an input shaft of the water pump 6 during running of the engine 1. Then the water pump 6 discharges the water coolant with a pressure according to the torque transmitted to the input shaft of the water pump 6. On the other hand, the water coolant does not circulate in the circulation channel A, since the water pump 6 is turned off when the engine 1 is at rest.

The water coolant discharged from the water pump 6 flows through the water jacket 23. At this time, heat is exchanged among the cylinder head 1*a*, the cylinder block 1*b*, and the water coolant. Some of the heat generated by combustion in cylinders 2 is conducted through the walls of the cylinders 2. Then the heat is conducted though the cylinder head 1*a* and the interior of the cylinder block 1*b*. As a result, temperatures at the cylinder head 1*a* and the entire cylinder block 1*b* rise. Some of the heat, conducted through the cylinder head 1*a* and the cylinder block 1*b*, is conducted to the water coolant in the water jacket 23. Then the water coolant temperature is raised. As a result, temperatures at the cylinder head 1*a* and the cylinder block 1*b* drop because of heat loss. As described above, the water coolant, whose temperature has been raised, flows out to the radiator inlet-side channel A1 from the cylinder head 1*a*.

The water coolant, which has flowed out to the radiator inlet-side channel A1, flows into the radiator 9 after flowing through the radiator inlet-side channel A1. At this time, heat is exchanged between outside air and the water coolant. Some of the heat of the high-temperature water coolant is conducted through the walls of the radiator 9, and then the heat is conducted to the interior of the radiator 9, so that the temperature of the entire radiator 9 is raised. Some of the heat, which has been conducted to the radiator 9, is conducted to outside air, so that the temperature of the outside air rises. On the other hand, the water coolant temperature drops due to heat loss. Then the water coolant, whose temperature has dropped, flows out of the radiator 9.

The water coolant, which has flowed out of the radiator 9, reaches the thermostat 8 after flowing through the radiator outlet-side channel A2. When the water coolant, which flows through the heater core outlet-side channel B2, reaches a predetermined temperature, internally stored wax expands to a certain extent. Then the thermostat 8 opens automatically by the thermal expansion of the wax. In other words, the radiator outlet-side channel A2 is shut off when the water coolant, which flows through the heater core outlet-side channel B2, does not reach a predetermined temperature. As a result, the water coolant in the radiator outlet-side channel A2 cannot pass the thermostat 8.

The water coolant, which has passed the thermostat 8, flows into the water pump 6 when the thermostat 8 is open.

As described above, the thermostat 8 opens, and the water coolant circulates in the radiator 9 only when the water coolant temperature is equal to or higher than a predetermined temperature. The water coolant, whose temperature has dropped at the radiator 9, is discharged to the water jacket 23 from the water pump 6. Then the water coolant temperature rises again.

On the other hand, some of the water coolant, which flows through the radiator inlet-side channel A1, flows into the heater core inlet-side channel B1.

The water coolant, which has flowed into the heater core inlet-side channel B1, reaches the shut-off valve 31 after flowing through the heater core inlet-side channel B1. The shut-off valve 31 is operated by the signals from the ECU 22. The valve is open during running of the engine 1, and the valve is closed when the engine 1 is at rest. During running of the engine 1, the water coolant reaches the heater core 13 after passing the shut-off valve 31 and flowing through the heater core inlet-side channel B1.

The heater core 13 exchanges heat with air in a compartment. Warmed air by heat conduction circulates in the compartment by a fan (not shown). As a result, an ambient temperature in the compartment rises. Then the water coolant merges into the radiator outlet-side channel A2 after flowing out of the heater core 13 and flowing through the heater core outlet-side channel B2. If the thermostat 8 is open at this time, the water coolant flows into the water pump 6 after merging with the water coolant flowing through the circulation channel A. On the other hand, the water coolant, which has flowed through the circulation channel B, flows into the water pump 6 without merging with the coolant in channel A if the thermostat 8 is closed.

As described above, the water coolant, whose temperature has dropped at the heater core 13, is discharged to the water jacket 23 from the water pump 6 again.

The engine 1 comprised as described above is also provided with the electronic control unit (ECU hereafter) 22 to control the engine 1. The ECU 22 controls the running status of the engine 1 according to running conditions of the engine 1 and requirements from a user (i.e. a driver). When the engine 1 is at rest, the ECU 22 has the functions of a heating control (engine preheating control) and a failure determination of the heat accumulator 10, etc.

The ECU 22 has various sensors such as a crank position sensor 27, the in-heat accumulator water coolant temperature sensor 28 and the in-engine water coolant temperature sensor 29, and the like. These sensors are connected through electrical wiring, so that output signals from the sensors can be input to the ECU 22.

The ECU 22 is connected, through electrical wiring, with the motor-driven water pump 12, the shut-off valve 31, the heater 32, etc. to control these parts.

Figure 2:
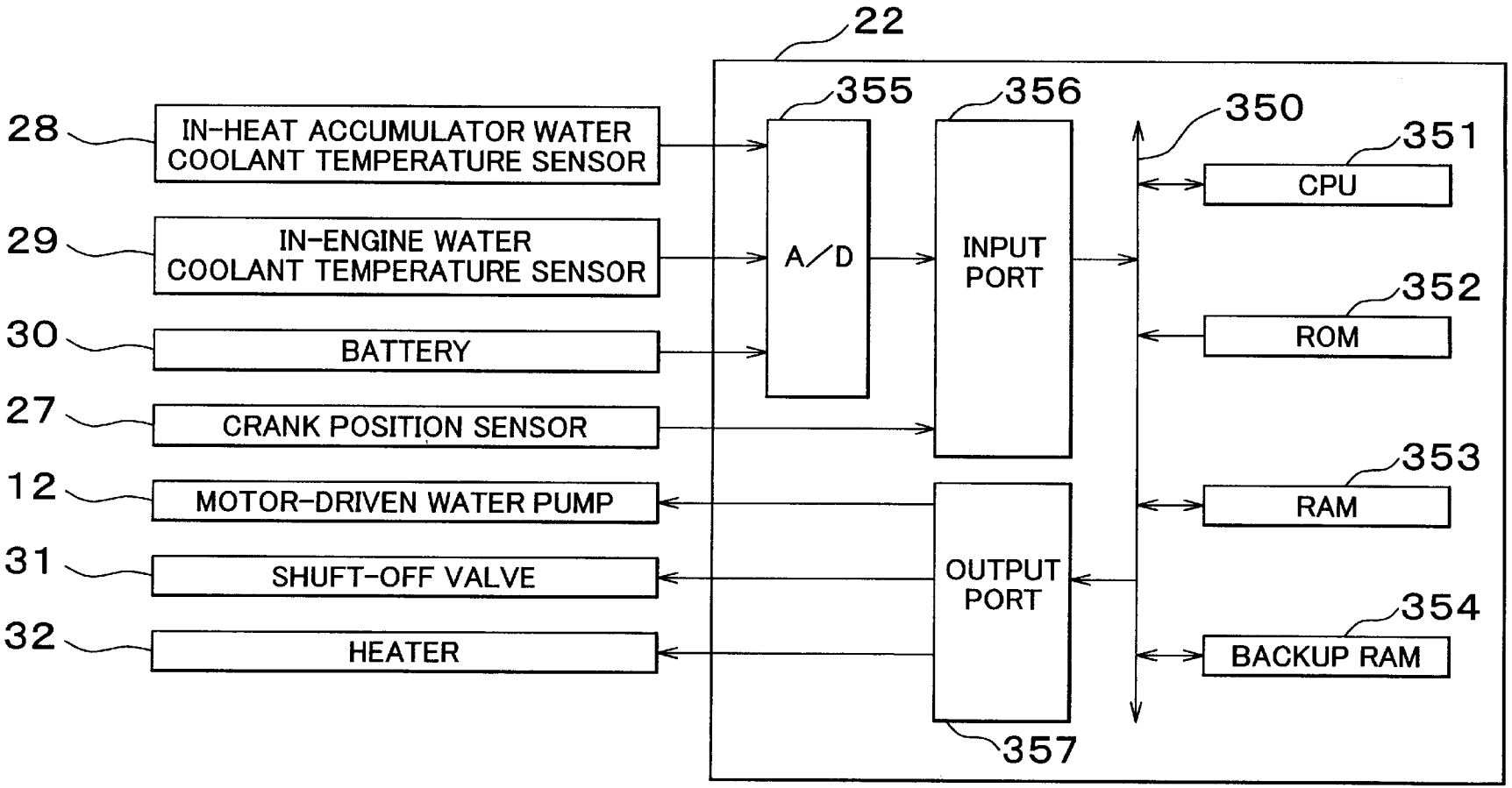
FIG. 2 is a block diagram showing an internal configuration of an Electronic Control Unit (ECU)

As shown in FIG. 2, the ECU 22 is provided with the CPU 351, a ROM 352, a RAM 353, a backup RAM 354, an input port 356, and an output port 357 all of which are connected each other by a bi-directional bus 350. The input port 356 is connected to an A/D converter 355.

The input port 356 inputs output signals from sensors such as the crank position sensor 27 which outputs digital signals, and then input port 356 transmits these signals to the CPU 351 and the RAM 353.

The input port 356 inputs output signals from sensors such as the in-heat accumulator water coolant temperature sensor 28, the in-engine water coolant temperature sensor 29, a battery 30, etc. which output analog signals through the A/D converter 355. Then the input port 356 transmits these signals to the CPU 351 and the RAM 353.

The output port 357 is connected, through electrical wiring, with the motor-driven water pump 12, the shut-off valve 31, the heater 32, etc. to transmit control signals output from the CPU 351 to the above-mentioned parts.

The ROM 352 stores application programs such as an engine preheating control routine for supplying heat from the heat accumulator 10 to the engine 1, a failure determination control routine for determining an abnormality of the heat accumulator 10, and a water coolant heating control routine by the heater 32.

In addition to the above-mentioned application programs, the ROM 352 stores various control maps such as a fuel injection control map which shows a relation between running status of the engine 1 and the amount of basic fuel injection (basic fuel injection time), and a fuel injection timing control map which shows a relation between running status of the engine 1 and basic fuel injection timing.

The RAM 353 stores output signals from each sensor, arithmetic results from the CPU 351, and so on. Engine revolutions calculated according to an interval of pulse signals from the crank position sensor 27 can be given as an example of an arithmetic result. Data are updated whenever the crank position sensor 27 outputs pulse signals.

The RAM 354 is a nonvolatile memory capable of storing data even after the engine 1 is turned off. For example, running time of the engine 1 is stored in the RAM 354.

The following explains the summary of the heating control of the engine 1 (hereinafter referred to as "engine preheat control").

During running of the engine 1, the ECU 22 transmits signals to the motor-driven water pump 12 to activate the pump 12. Then the water coolant circulates in the circulation channel C.

Some of the water coolant, which flows through the heater core outlet-side channel B2, flows into the heat accumulating device inlet-side channel C1. Then the water coolant reaches the motor-driven water pump 12 after flowing through the heat accumulating device inlet-side channel C1. The motor-driven water pump 12 is driven by the signals from the ECU 22, and discharges the water coolant with a predetermined pressure.

The water coolant, which has been discharged from the motor-driven water pump 12, reaches the heat accumulator 10 after flowing through the heat accumulator inlet-side channel C1 and passing the reverse flow-preventing valve 11. The water coolant, which has flowed into the heat accumulator 10 from the water coolant injecting tube 10*c*, flows out of the heat accumulating device from the water coolant extracting tube 10*d*.

The water coolant, which has flowed into the heat accumulator 10, is insulated from outside, and its heat is retained. The water coolant, which has flowed out of the heat accumulator 10, flows into the radiator inlet-side channel A1 after passing the reverse flow-preventing valve 11 and flowing through the heat accumulator outlet-side channel C2.

As described above, the water coolant, which has been heated by the engine 1, flows through the interior of the heat accumulator 10. Therefore, the interior of the heat accumulator 10 is filled with the high-temperature water coolant. In addition, the high-temperature water coolant can be accumulated in the heat accumulator 10 when the ECU 22 stops driving the motor-driven water pump 12 after the engine 1 is turned off. By the insulation effect of the heat accumulator 10, the accumulated water coolant is restrained from dropping its temperature.

The engine preheating control is initiated by activation of the ECU 22 when trigger signals are input in the ECU 22.

Door opening and closing signals of a driver-side door transmitted from a door opening and closing sensor (not shown) are one example of trigger signals. To start the engine 1 mounted on a vehicle, a driver naturally opens a door to get into a vehicle before starting the engine. Therefore, the ECU 22 can be connected to a door opening and closing sensor, so that the ECU 22 is activated and starts carrying out the engine preheating control when the door opening and closing sensor detects that the door is opened. Therefore, the engine will be warmed up when the driver starts the engine 1.

On the other hand, the engine preheating control may be initiated when the water coolant temperature in the engine 1 is lower than a predetermined temperature Te. The predetermined temperature Te is determined according to a requirement of emission.

The ECU 22 also carries out the engine preheating control by circulating the high-temperature water coolant, which has been accumulated in the heat accumulator 10, in the circulation channel C when the engine 1 is at rest (i.e., prior to starting the engine).

Figure 3:
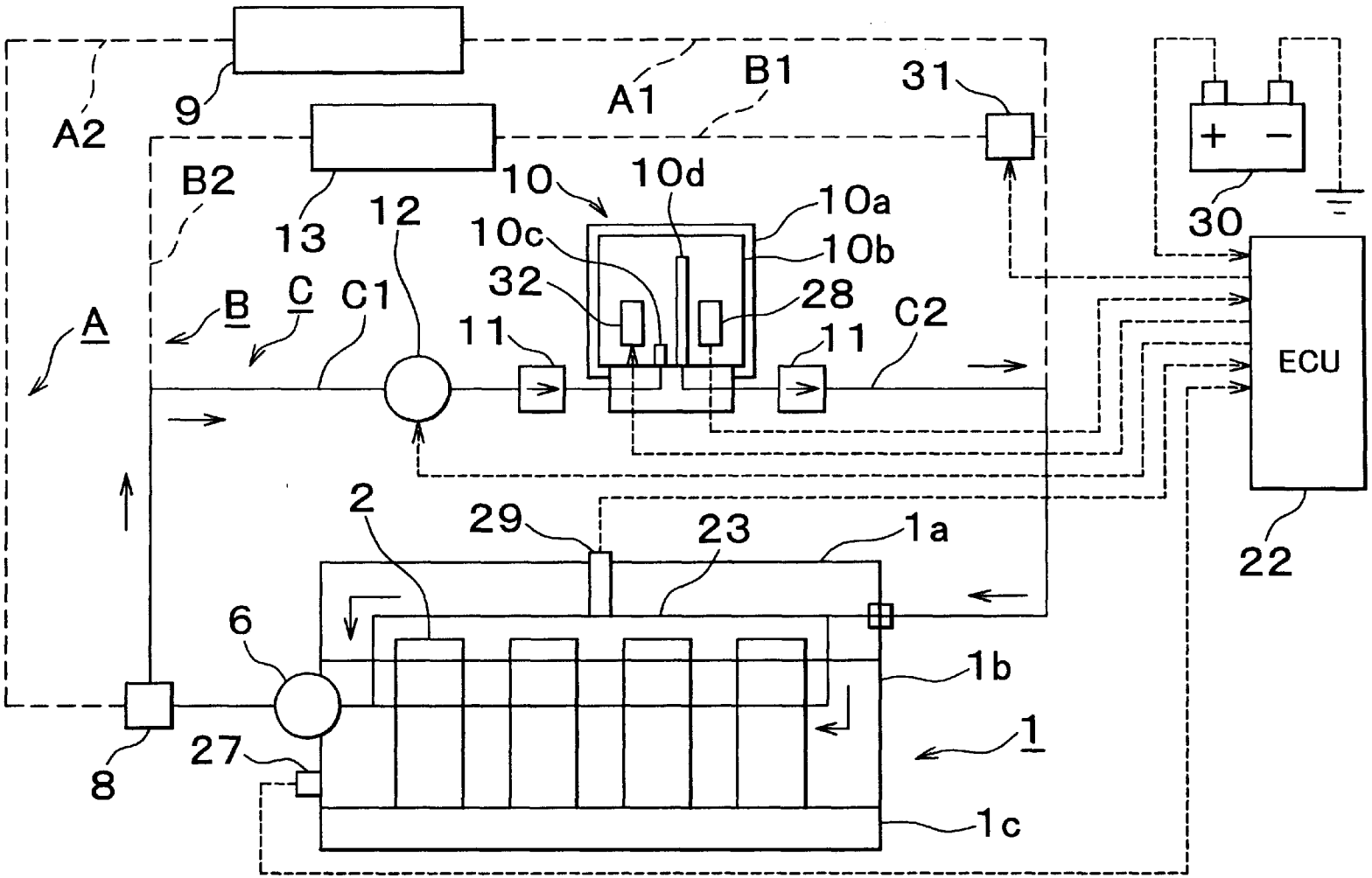
FIG. 3 is a view showing channels and circulating directions of the water coolant when heat is supplied to the engine from the heat accumulating device in conditions where the engine is at rest.

FIG. 3 shows the water coolant circulation channels and the circulation directions of the water coolant when heat from the heat accumulator 10 is supplied to the engine 1 which is at rest. The circulation directions of the water coolant in the water jacket 23 when the heat is supplied to the engine 1 from the heat accumulator 10 are opposite to those of the water coolant in the water jacket 23 during running of the engine 1. The shut-off valve 31 is closed by the ECU 22 during the engine preheating control.

The motor-driven water pump 12 is driven according to the signals from the ECU 22 and discharges the water coolant with the predetermined pressure. The discharged water coolant reaches the heat accumulator 10 after flowing through the heat accumulator inlet-side channel C1 and passing the reverse flow-preventing valve 11. At this time, the water coolant, which flows into the heat accumulator 10, is the water coolant whose temperature has dropped when the engine 1 was at rest.

The water coolant, which has been accumulated in the heat accumulator 10, flows out of the heat accumulator 10 through the water coolant extracting tube 10*d*. At this time, the water coolant, which flows out of the heat accumulator 10, is the water coolant which has been insulated by the heat accumulator 10 after flowing into the heat accumulator 10 during running of the engine 1. The water coolant, which flows out of the heat accumulator 10, flows into the cylinder head 1*a* after passing the reverse flow-preventing valve 11 and flowing through the heat accumulating device outlet-side channel C2. When the engine 1 is at rest, water coolant does not circulate in the heater core 13 since the shut-off valve 31 is closed according to the signals from the ECU 22. In addition, the engine preheating control is not carried out when the water coolant temperature is higher than a temperature to open a valve of the thermostat 8 since it is not necessary to supply heat from the heat accumulator 10 to the engine 1 under such circumstances. In other words, when the water coolant circulates and the engine 1 is at rest, the thermostat 8 is always closed. Therefore, the water coolant temperature does not drop because of heat conduction since the water coolant does not circulate in the heater core 13 and the radiator 9 during the engine preheating control.

The water coolant, which has flowed into the cylinder head 1*a*, flows through the water jacket 23. The cylinder head 1*a* exchanges heat with the water coolant in the water jacket 23. Some of the heat from the water coolant is conducted to the cylinder head 1*a* and the interior of the cylinder block 1*b*, and the temperature of the entire engine rises. As a result, the water coolant temperature drops due to heat loss.

As described above, the water coolant, whose temperature has dropped through the heat conduction in the water jacket 23, reaches the motor-driven water pump 12 after flowing out of the cylinder block 1*b* and flowing through the heat accumulating device inlet-side channel C1.

As described above, the ECU 22 heats the cylinder head 1*a* (engine preheating control) by activating the motor-driven water pump 12 prior to starting the engine 1.

Meanwhile, in a system applied to the present exemplary embodiment, in other words, a system for exchanging heat between the engine 1 and the heat accumulator 10 by the water coolant circulating in both those parts, heat is not supplied to the engine 1 when the circulation channel C for circulating the water coolant in both the parts is aging, and does not function properly. Therefore, the effect of heat accumulation cannot sufficiently be achieved. In a conventional system under the above-mentioned condition, a user can learn of an abnormality in the circulation channel by a temperature, which is indicated according to signals from a temperature sensor provided in the heat accumulator 10, on a temperature indicating panel provided in a compartment of the vehicle.

However, if the engine 1 is turned off immediately after the engine 1 is started and before the water coolant temperature sufficiently rises, a high-temperature water coolant cannot be introduced in the heat accumulator 10. Therefore, the in-heat accumulator water coolant temperature sensor 28 transmits signals indicating a low temperature. As a result, the low temperature is indicated on the temperature indicating panel, so that an abnormality in the insulating function of the heat accumulator 10 may be indicated. In other words, if the failure determination is carried out only according to the temperature in the heat accumulator 10, an accurate determination result cannot be obtained.

According to the present exemplary embodiment, the failure determination is carried out according to whether or not there is a variation in temperature of the water coolant when the engine preheating control is being carried out to obviate the above-mentioned problem. The engine 1, according to the present exemplary embodiment, emits heat to outside or into the atmosphere after being turned off, so that the temperature of the engine 1 drops gradually. On the other hand, the heat accumulator 10 accumulates and insulates the water coolant whose temperature has risen more or less during running of the engine 1. If the engine preheating control is carried out under this condition, the temperature in the engine 1, supplied with the high-temperature water coolant, rises as the temperature in the heat accumulator 10 drops since the water coolant, whose temperature has dropped in the engine 1, flows into the heat accumulator 10. Therefore, a difference in internal temperature between the engine 1 and the heat accumulator 10 becomes smaller (decreases). However, if the circulation channel C and each part, which is provided at the circulation channel C, are aging and do not function properly, the water coolant accumulated in the heat accumulator 10 does not move and remains in the heat accumulator 10. Therefore, water coolant temperatures in the heat accumulator 10 and the engine 1 do not change. Therefore, the difference in internal temperature between the engine 1 and the heat accumulator 10 remains large.

As described above, if there is an abnormality in the insulation performance of the heat accumulator 10 or a failure of the other parts, the difference in internal temperature between the engine 1 and the heat accumulator 10 remains large. Therefore, the failure determination is possible by measuring water coolant temperatures in the heat accumulator 10 and the engine 1.

Figure 4:
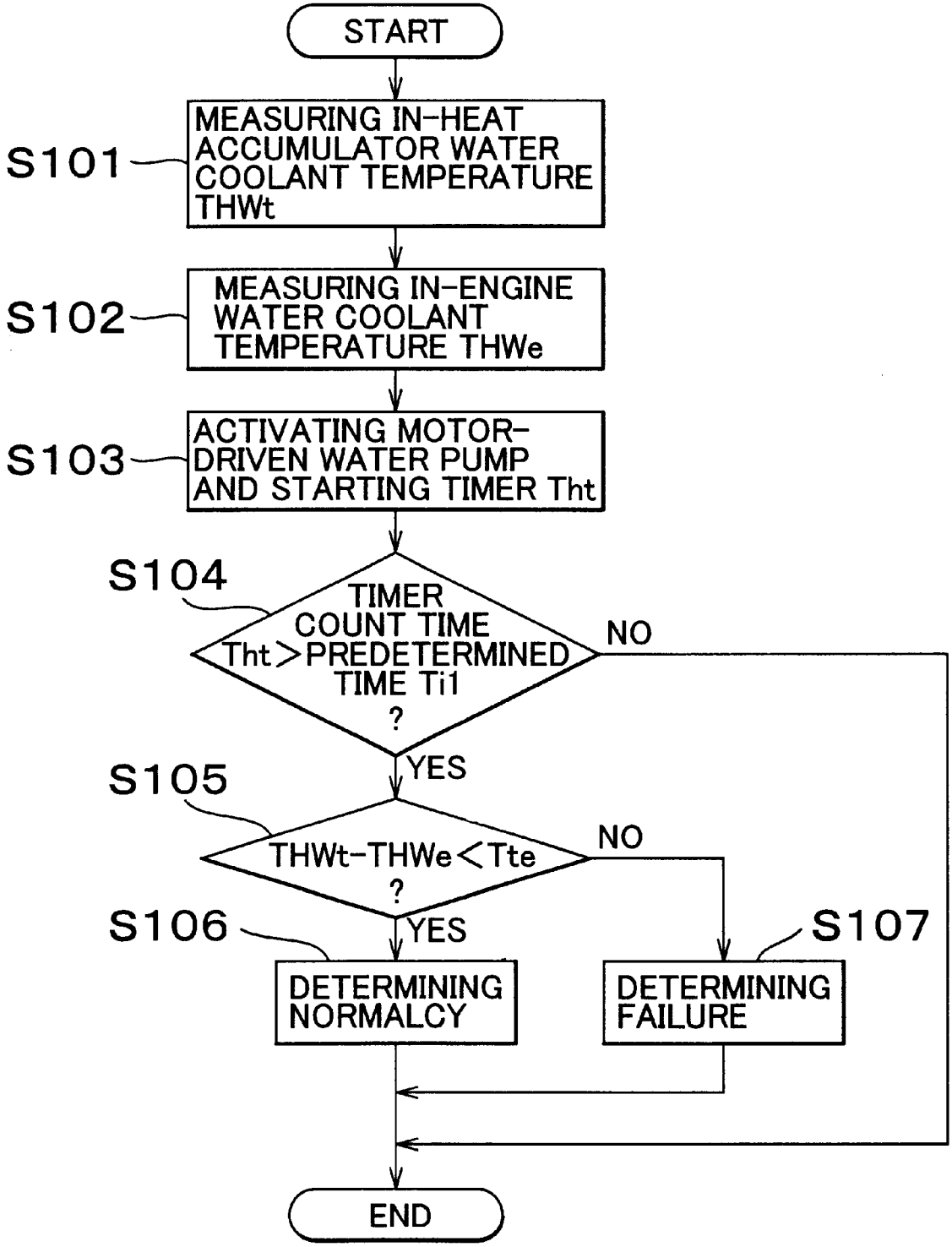
FIG. 4 is a flow chart showing the flow of a failure determination according to a first exemplary embodiment of the invention.

The following explains the process when the failure determination is carried out. FIG. 4 is a flow chart showing the flow of the failure determination. The failure determination control is carried out accompanied by the engine preheating control. The present control is initiated when the ECU 22 is activated according to the trigger signals input to the ECU 22.

At step S101, a water coolant temperature THWt in the heat accumulator 10 is measured. The ECU 22 stores output signals from the in-heat accumulator water coolant temperature sensor 28 in the RAM 353.

At step S102, a water coolant temperature THWe in the engine 1 is measured. The ECU 22 stores output signals from the in-engine water coolant temperature sensor 29 in the RAM 353.

At step S103, the ECU starts a timer for measuring driving time of the motor-driven pump 12 in addition to activating the motor-driven water pump 12 to circulate the water coolant in the engine 1.

At step S104, the ECU 22 determines whether a predetermined time Ti1 has elapsed or not after activation of the motor-driven water pump 12. The predetermined time Ti1 is a time for a difference in temperature of the water coolant between the heat accumulator 10 and the engine 1 to reach an equilibrium state, and it can be calculated without undue experimentation. The ECU 22 proceeds to step S105 if count time Tht is longer than the predetermined time Ti1, and ends the present routine for the moment if the count time Tht is equal to or shorter than the predetermined time Ti1.

At step S105, the ECU determines the following three things: whether or not a difference between the in-heat accumulator 10 water coolant temperature THWt and the in-engine 1 water coolant temperature THWe is lower than a predetermined value Tte, whether or not the in-heat accumulator 10 water coolant temperature THWt is lower than a predetermined value Tt1, and whether or not the in-engine 1 water coolant temperature THWe is higher than a predetermined value Te1.

Figure 5:
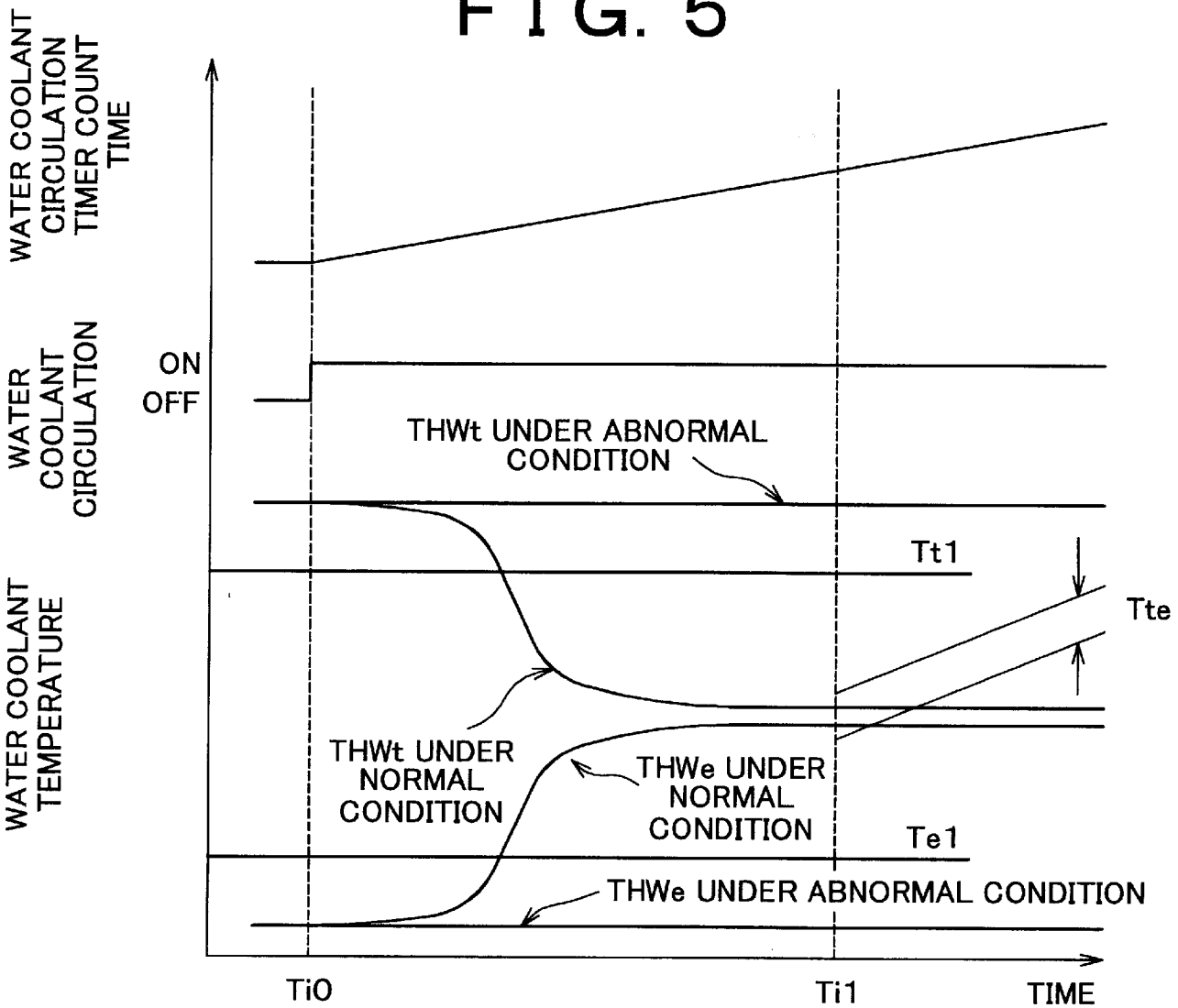
FIG. 5 is a time chart showing transitions of an in-heat accumulator water coolant temperature THWt and an in-engine water coolant temperature THWe according to the first exemplary embodiment of the invention.

FIG. 5 is a time chart showing transitions of the in-heat accumulator 10 water coolant temperature THWt and the in-engine 1 water coolant temperature THWe when circulation of the water coolant is carried out normally or abnormally. When the water coolant is supplied to the engine 1 from the heat accumulator 10, the temperature in the heat accumulator 10 drops as the temperature in the engine 1 rises. If the water coolant is supplied in this way, the temperatures in both the parts (1 and 10) gradually come closer to each other.

However, if circulation of the water coolant is not carried out because of reasons such as a failure of the motor-driven pump 12, blockage in the circulation channel C, or the reverse flow-preventing valve 11 not functioning properly, the water coolant temperatures in both the parts are kept approximately constant even if the engine preheating control is carried out.

Therefore, with the above-mentioned characteristics taken into consideration, it can be concluded that circulation of the water coolant has been carried out normally if the difference between the in-heat accumulator 10 water coolant temperature THWt and the in-engine 1 water coolant temperature THWe is lower than the predetermined value Tte.

At this time, the determinations may be carried out according to either the in-heat accumulator 10 water coolant temperature THWt or the in-engine 1 water coolant temperature THWe. In other words, when the water coolant is circulated normally, the water coolant temperature in the heat accumulator 10 drops, and the dropped temperature can be measured as the temperature Tt1 in advance. Therefore, it can be concluded that circulation of the water coolant has been carried out normally if the in-heat accumulator 10 water coolant temperature THWt is lower than the temperature Tt1. Likewise, when the water coolant is circulated normally, the water coolant temperature in the engine 1 rises, and the risen temperature can be measured as the temperature Te1 in advance. Therefore, it can be concluded that circulation of the water coolant has been carried out normally if the in-engine 1 water coolant temperature THWe is higher than the temperature Te1. Furthermore, the in-heat accumulator 10 water coolant temperature THWt may be the temperature of the water coolant flowing out of the heat accumulator 10 instead of that of the water coolant in the heat accumulator 10.

At steps S106 and S107, determinations similar to the ones described above are carried out. At these steps, it can be determined that there is a failure of the heat accumulating device because of reasons such as an abnormality in the reverse flow-preventing valve 11, blockage or breakage of the circulation channel C, or malfunction of the motor-driven pump 12.

If it is determined that there is a failure, a warning light (not shown) may be turned on to alert a user. In addition, the ECU 22 may be programmed so that it does not carry out the engine preheating control again.

In a conventional engine, faulty circulation of water coolant because of aging is not considered. Furthermore, a failure determination is carried out on the assumption that the water coolant has completely been warmed up.

However, when the engine 1 is turned off immediately after the engine 1 is started and before the water coolant temperature sufficiently rises, a high-temperature water coolant cannot be introduced into the heat accumulator 10. Therefore, an accurate determination result cannot be obtained by the failure determination carried out only according to the temperature in the heat accumulator 10 when the engine 1 is started next time.

On the other hand, the failure determination is carried out in consideration of the difference in temperature of the water coolant between the heat accumulator 10 and the engine 1 according to the engine with the heat accumulating device relating to the present exemplary embodiment. Therefore, the failure determination can be carried out even if the engine 1, which is has not been warmed up completely, is turned off.

According to the embodiment described above, faulty circulation of the water coolant can be determined according to the water coolant temperatures in the engine 1 and the heat accumulator 10 when the engine preheating control is being carried out.

The Second Exemplary Embodiment

The following discussion explains the differences between the first embodiment and the present exemplary embodiment. In the first embodiment, mainly the determination of faulty circulation of the water coolant because of a failure of the circulation channel is carried out. On the other hand, determination of deterioration in the insulation function of the heat accumulator 10 is carried out in the second exemplary embodiment.

In addition, the failure determination is carried out when the engine preheating control is being carried out according to the first embodiment. However, a failure determination is carried out before the engine preheating control is carried out according to the present embodiment.

Though the embodiment has adopted different objects and a method for the failure determination compared with the first embodiment, the engine 1 and a basic configuration of the other hardware are common to those of the first embodiment. Therefore, explanation of them has been omitted.

Meanwhile, in a system applied to the present embodiment, in other words, a system for exchanging heat between the engine 1 and the heat accumulator 10 by water coolant circulating in both these parts if insulation performance of the heat accumulator 10 deteriorates through its aging, the water coolant temperature in the engine 1 and in the heat accumulator 10 gradually drops after the engine is turned off. If starting the engine 1 is delayed for some reason, the engine 1 needs to be heated again since the temperature of the engine 1, which had once been heated, drops. At this time, the water coolant temperature in the heat accumulator 10 has dropped, so that a sufficient effect of heating the engine 1 by circulating the water coolant cannot be achieved. In a conventional system under the above-mentioned condition, a user can learn of a drop in temperature of the water coolant by a temperature, which is indicated on a temperature indicating panel provided in a compartment, according to signals from a temperature sensor provided in the heat accumulator 10.

However, if the engine 1 is turned off immediately after the engine 1 is started and before the water coolant temperature sufficiently rises, a high-temperature water coolant cannot be introduced into the heat accumulator 10. In this case, an accurate determination result cannot be obtained if the failure determination is carried out only according to the temperature in the heat accumulator 10.

According to the present exemplary embodiment, the failure determination is carried out according to the water coolant temperatures in the engine 1 and in the heat accumulator 10 before the engine preheating control is carried out to obviate the above-mentioned problem. The engine 1, according to the present embodiment, emits heat to the outside or into the outside air after being turned off, so that the temperature of the engine 1 drops gradually. On the other hand, the heat accumulator 10 accumulates and insulates the water coolant whose temperature has risen more or less during running of the engine 1. Therefore, the water coolant temperature in the heat accumulator 10 becomes higher than that of the water coolant in the engine 1; however, it becomes approximately equal to the water coolant temperature in the engine 1 if there is an abnormality in the insulation performance of the heat accumulator 10, which causes the temperature of the water coolant accumulated in the heat accumulator 10 to drop.

As described above, if the insulation performance of the heat accumulator 10 deteriorates, the water coolant temperature in the heat accumulator 10 becomes approximately equal to that of the water coolant in the engine 1. Therefore, it can be determined that there is a failure when the water coolant temperature in the engine 1 is higher than that of the water coolant in the heat accumulator 10 after measuring the water coolant temperatures in both those parts.

Figure 6:
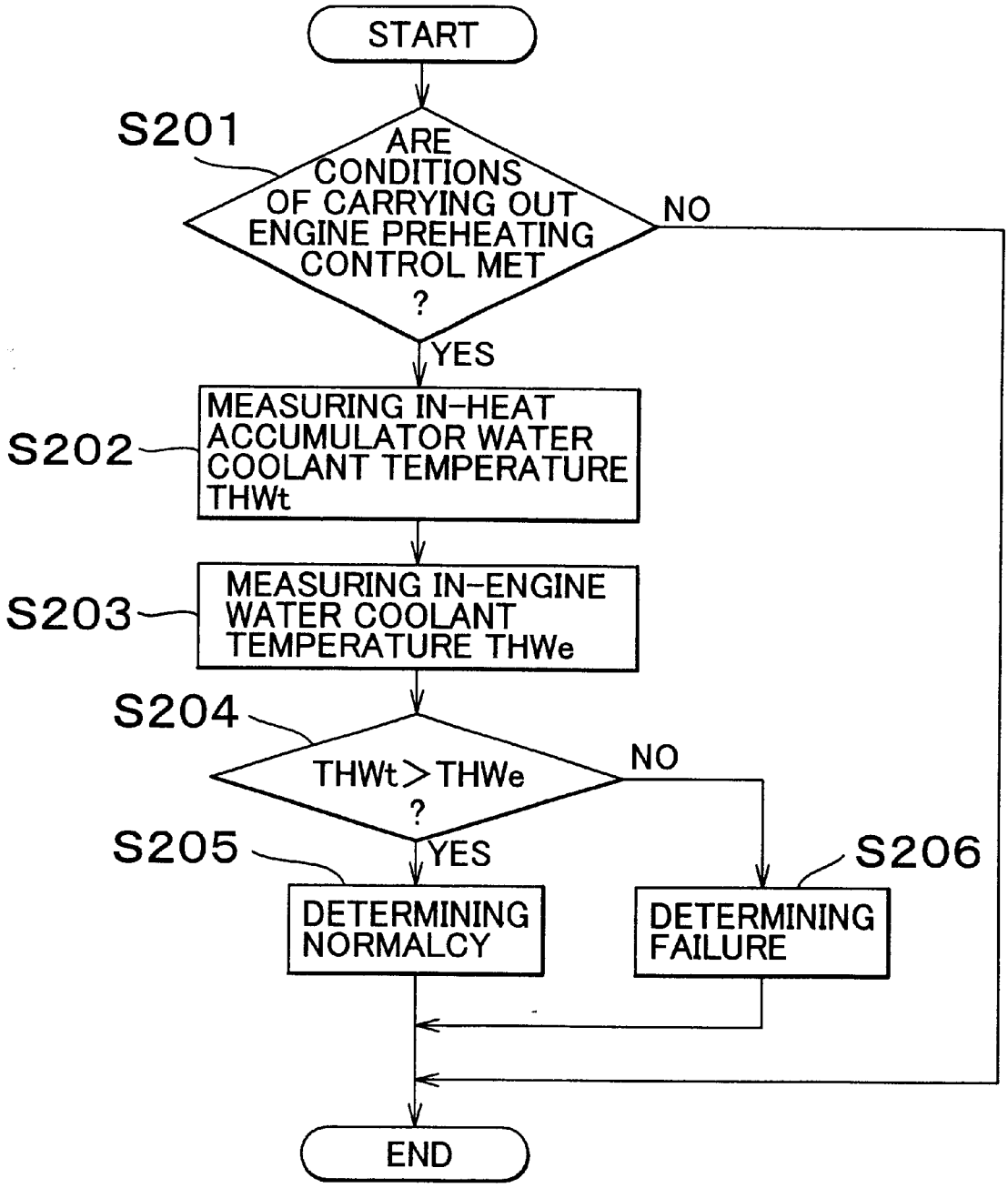
FIG. 6 is a flow chart showing the flow of a failure determination according to a second exemplary embodiment of the invention.

The following explains the control flow when the failure determination is carried out. FIG. 6 is a flow chart showing the flow of the failure determination.

The failure determination control is carried out before the engine preheating control is carried out. The present control is initiated when the ECU 22 is activated according to the trigger signals input into the ECU 22.

At step S201, the ECU 22 determines whether or not conditions for carrying out the engine preheating control are met. Heat from the heat accumulator 10 slowly flows outside, so that the temperature of the water coolant accumulated in the heat accumulator 10 gradually drops. Therefore, the failure determination is not carried out if the engine 1 has been at rest for a long period of time because of the drop in temperature of the water coolant in the heat accumulator 10, which makes carrying out an accurate failure determination difficult.

If the determination at step S201 is affirmative, the routine proceeds to step S202, and if negative, it ends the present routine.

At step S202, the water coolant temperature THWt in the heat accumulator 10 is measured. The ECU 22 stores the output signals from the in-heat accumulator water coolant temperature sensor 28 in the RAM 353.

At step S203, the water coolant temperature THWe in the engine 1 is measured. The ECU 22 stores the output signals from the in-engine water coolant temperature sensor 29 in the RAM 353.

At step S204, the CPU determines whether or not the water coolant temperature THWt in the heat accumulator 10 is higher than the water coolant temperature THWe in the engine 1. The high-temperature water coolant, introduced during running of the engine 1, is accumulated in the heat accumulator 10. On the other hand, the temperature in the engine 1 has dropped to be approximately equal to an atmospheric temperature.

However, the temperature in the heat accumulator 10 also drops to be approximately equal to the temperature in the engine 1, if the insulation performance of the heat accumulator 10 deteriorates. Therefore, if the water coolant temperature THWt in the heat accumulator 10 is higher than the water coolant temperature THWe in the engine 1 before the engine preheating control is carried out, it can be determined that the insulation function of the heat accumulator 10 is normal since the water coolant in the heat accumulator 10 has been insulated.

At steps S205 and S206, determinations similar to the ones described above are carried out. At these steps, it can be determined that there is a failure of the heat accumulating device when the water coolant temperature in the heat accumulator 10 drops like when the insulation function of the heat accumulator 10 deteriorates, or there is a failure of the heater 32.

If it is determined that there is a failure, a warning light (not shown) may be turned on to alert a user. In addition, the ECU 22 may be programmed so that it does not carry out the engine preheating control after this determination is made. In a conventional engine, a failure determination to determine deterioration in the insulation performance of the heat accumulating device is carried out on the assumption that the water coolant has been warmed up completely.

However, when the engine 1 is turned off immediately after the engine 1 is started and before the water coolant temperature sufficiently rises, a high-temperature water coolant cannot be introduced in the heat accumulator 10. Therefore, an accurate determination result cannot be obtained by the failure determination carried out only according to the temperature in the heat accumulator 10 when the engine 1 is started next time.

On the other hand, the failure determination is carried out in consideration of the difference in temperature of the water coolant between the heat accumulator 10 and the engine 1 according to the engine with the heat accumulating device relating to the present embodiment. Therefore, the failure determination can be carried out even if the engine 1, which has not been warmed up completely, is turned off.

According to the embodiment described above, deterioration in the insulation performance of the heat accumulator 10 can be determined according to the water coolant temperatures in the engine 1 and in the heat accumulator 10 before the engine preheating control is carried out.

The Third Exemplary Embodiment

The following discussion explains the differences between the second embodiment and the present exemplary embodiment. In the second embodiment, the determination of deterioration in the insulation performance is carried out before the engine preheating control is carried out. On the other hand, determination of deterioration in the insulation function is carried out under the following two conditions according to the third embodiment. The first condition is that the engine 1 is at rest or the engine preheating control has been ended. The second condition is that the predetermined time has elapsed after stopping circulation of the water coolant.

Though the present embodiment has adopted different objects and a method for the failure determination compared with the first embodiment, the engine 1 and a basic configuration of the other hardware are common to those of the first embodiment. Therefore, explanation of them has been omitted.

Meanwhile, in a system applied to the present exemplary embodiment, in other words, a system for exchanging heat between the engine 1 and the heat accumulator 10 by water coolant circulating in both these parts if insulation performance of the heat accumulator 10 deteriorates through its aging, the water coolant temperature in the engine 1 and in the heat accumulator 10 gradually drops after the engine is turned off or the engine preheating control is ended. If starting the engine 1 is delayed for some reason, the engine 1 needs to be heated again since the temperature of the engine 1, which has once been heated, drops. At this time, the water coolant temperature in the heat accumulator 10 has dropped, so that a sufficient effect of heating the engine 1 by circulating the water coolant cannot be achieved. In a conventional system under the above-mentioned condition, a user can learn of a drop in temperature of the water coolant by a temperature, which is indicated on a temperature indicating panel provided in a compartment, according to signals from a temperature sensor provided in the heat accumulator 10.

However, if the engine 1 is turned off immediately after the engine 1 is started and before the water coolant temperature sufficiently rises, a high-temperature water coolant cannot be introduced into the heat accumulator 10. In this case, an accurate determination result cannot be obtained if the failure determination is carried out only according to the temperature in the heat accumulator 10.

According to the present exemplary embodiment, the failure determination is carried out according to the water coolant temperatures in the engine 1 and the heat accumulator 10 under the following two conditions to obviate the above-mentioned problem. The first condition is that the engine 1 is at rest or the engine preheating control has been ended. The second condition is that the predetermined time has elapsed after stopping circulation of the water coolant. The engine 1 emits heat to outside or into the atmosphere after it is turned off, so that the temperature of the engine 1 drops gradually. On the other hand, the heat accumulator 10 accumulates and insulates the water coolant whose temperature has risen more or less during running of the engine 1. If the engine preheating control is carried out under this condition, the temperature in the heat accumulator 10 drops since the water coolant, whose temperature has dropped in the engine 1, flows into the heat accumulator 10 in addition to supplying the heated water coolant to the engine 1 from the heat accumulator 10. Then the water coolant temperature in the heat accumulator 10 becomes approximately equal to that of the water coolant in the engine 1. On the other hand, the water coolant temperatures in the heat accumulator 10 and the engine 1 are approximately the same immediately after the engine 1 is turned off.

If the engine is not started when the water coolant temperatures in the heat accumulator 10 and the engine 1 are approximately the same, the water coolant temperature in the engine 1 drops again, and a difference in temperature between the water coolant in the engine 1 and the water coolant insulated in the heat accumulator 10 becomes larger.

However, if the temperature in the heat accumulator 10 drops because of deterioration in the insulation performance of the heat accumulator 10, the difference in temperature between the water coolant in the engine 1 and the water coolant in the heat accumulator 10 becomes smaller.

If the insulation performance of the heat accumulator 10 deteriorates, the difference in temperature between the water coolant in the engine 1 and the water coolant in the heat accumulator 10 becomes smaller after the predetermined time has elapsed since the engine 1 is stopped or the engine preheating control is ended. Therefore, the failure determination is possible by measuring and comparing the water coolant temperatures in the heat accumulator 10 and the engine 1.

Figure 7:
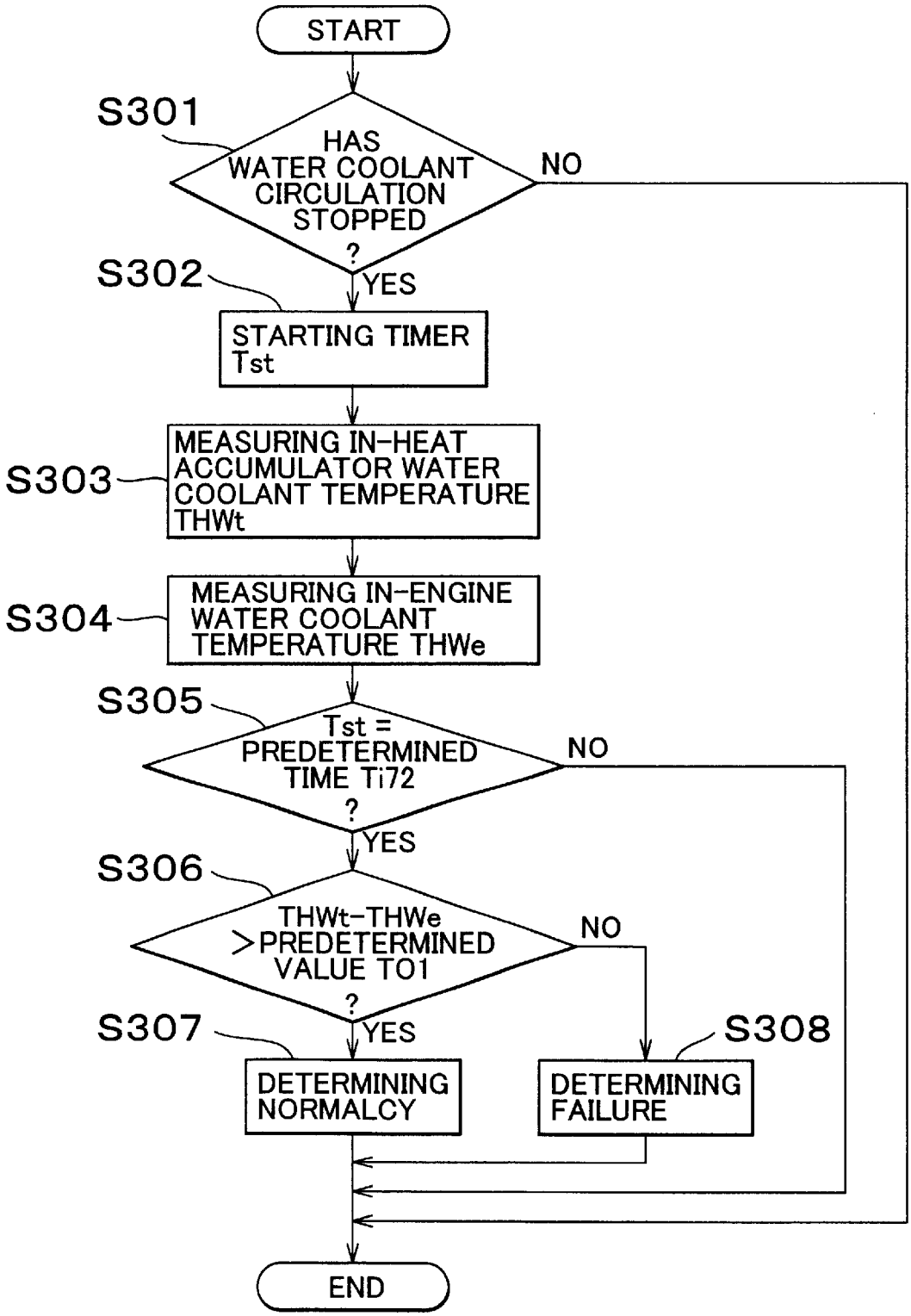
FIG. 7 is a flow chart showing the flow of a failure determination according to a third exemplary embodiment of the invention.

The following explains the control flow when the failure determination is carried out. FIG. 7 is a flow chart showing the flow of the failure determination.

The failure determination control is carried out after the engine preheating control is carried out or the engine 1 is turned off. In other words, the present control is carried out after circulation of the water coolant is stopped.

At step S301, the ECU 22 determines whether or not a condition of carrying out the failure determination control is met. The condition can be whether the water coolant circulation flow has stopped, which occurs when turning off the engine 1 or when ending the engine preheating control. The water coolant temperatures in the heat accumulator 10 and the engine 1 are approximately the same immediately after the engine 1 is turned off or the engine preheating control is ended.

If the determination is affirmative at step S301, the routine proceeds to step S302, and if negative, it ends the present routine.

At step S302, the ECU 22 starts a timer for counting elapsed time from turning off the engine 1 or ending the engine preheating control.

At step S303, the water coolant temperature THWt in the heat accumulator 10 is measured. The ECU 22 stores the output signals from the in-heat accumulator water coolant temperature sensor 28 in the RAM 353.

At step S304, the water coolant temperature THWe in the engine 1 is measured. The ECU 22 stores the output signals from the in-engine water coolant temperature sensor 29 in the RAM 353.

At step S305, the ECU 22 determines whether or not count time Tst of the timer is equal to a predetermined time Ti72 (72 hours, for example). If the determination is affirmative, the CPU 22 proceeds to step S306, and if negative, it ends the present routine.

At step S306, the CPU 22 determines whether or not a difference between the in-heat accumulator 10 water coolant temperature THWt and the in-engine 1 water coolant temperature THWe is higher than a predetermined value T01.

Figure 8:
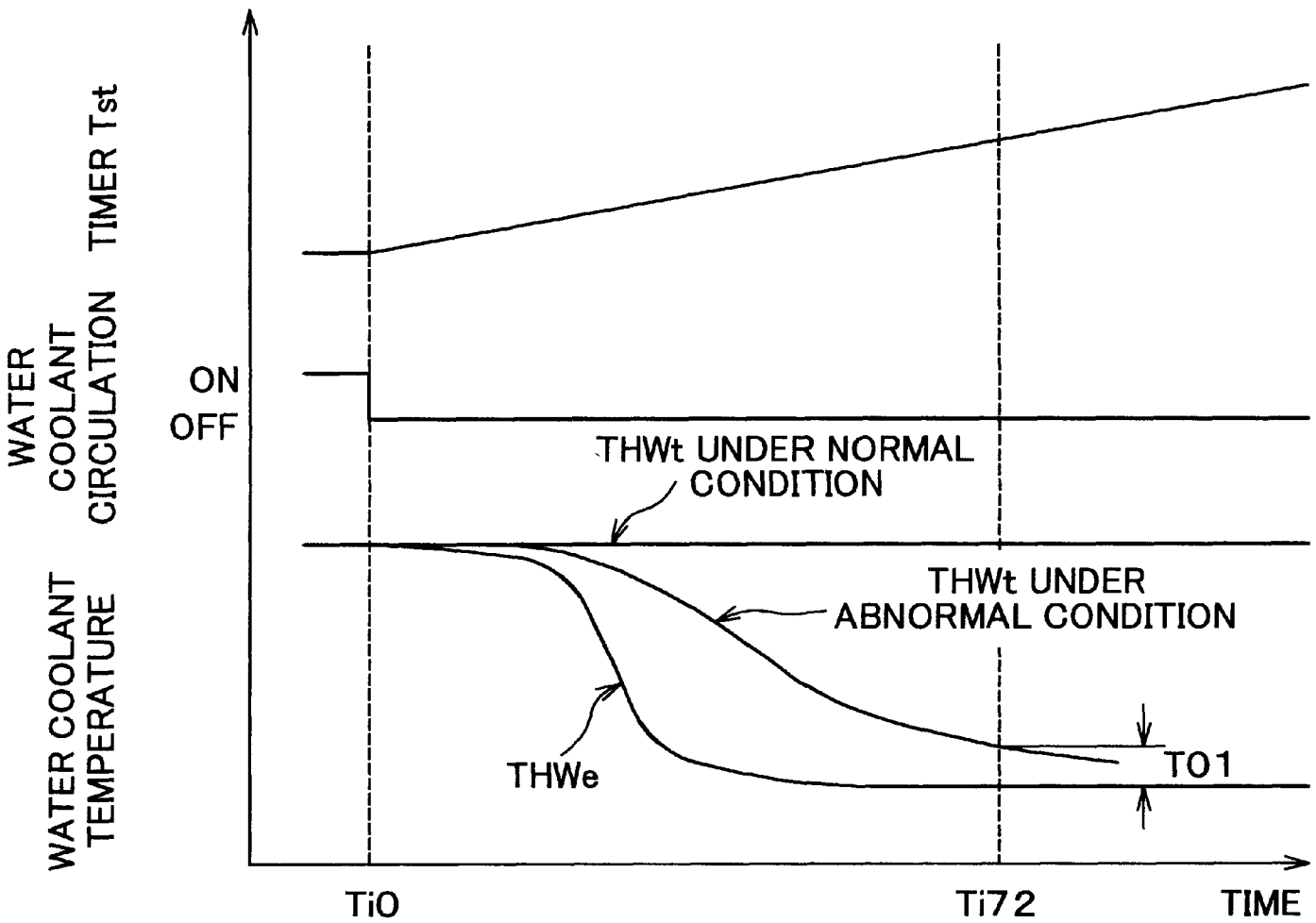
FIG. 8 is a time chart showing transitions of an in-heat accumulator water coolant temperature THWt and an in-engine water coolant temperature THWe according to the third exemplary embodiment of the invention.

FIG. 8 is a time chart showing transitions of the in-heat accumulator water coolant temperature THWt and the in-engine water coolant temperature THWe until the predetermined time Ti72 elapses after circulation of the water coolant is stopped. The temperature of the water coolant accumulated in the heat accumulator 10 is approximately the same as that of the water coolant accumulated in the engine 1 immediately after the water coolant is supplied to the engine 1 from the heat accumulator 10 or the engine 1 is turned off. If the engine is not started after this, heat is emitted into the outside air, so that the water coolant temperature in the engine 1 drops. On the other hand, the water coolant temperature in the heat accumulator 10 is kept approximately constant.

However, if the insulation performance of the heat accumulator 10 deteriorates, the temperature in the heat accumulator 10 also drops. If the difference between the in-heat accumulator 10 water coolant temperature THWt and the in-engine 1 water coolant temperature THWe is higher than the predetermined value T01 after the predetermined time Ti72 has elapsed since the engine preheating control is ended, it can be determined that the water coolant in the heat accumulator 10 has been insulated.

According to the present embodiment, it may be determined that the insulation performance is normal if the in-heat accumulator 10 water coolant temperature THWt is higher than the in-engine 1 water coolant temperature THWe after the predetermined time Ti72 has elapsed. In addition, it may also be determined that the insulation performance is normal if the in-heat accumulator 10 water coolant temperature THWt is higher than a predetermined temperature calculated in advance after the predetermined time Ti72 has elapsed.

At steps S307 and S308, determinations similar to the ones described above are carried out. At these steps, it can be determined that there is a failure of the heat accumulating device when the water coolant temperature drops because of reasons such as deterioration in the insulation performance of the heat accumulator 10 or a failure of the heater 32.

If it is determined that there is a failure, a warning light (not shown) may be turned on to alert a user. In addition, the ECU 22 may be programmed so that it does not carry out the engine preheating control any further.

In a conventional engine, a failure determination to determine deterioration in the insulation performance of the heat accumulating device is carried out on the assumption that the water coolant is accumulated in the heat accumulator 10 in conditions where the water coolant has completely been warmed up.

However, when the engine 1 is turned off immediately after the engine 1 is started and before the water coolant temperature sufficiently rises, a high-temperature water coolant cannot be introduced into the heat accumulator 10. Therefore, an accurate determination result cannot be obtained by the failure determination carried out only according to the temperature in the heat accumulator 10 at this time.

According to the engine with the heat accumulating device relating to the present embodiment, on the other hand, the failure determination is carried out in consideration of the difference in temperature of the water coolant between the heat accumulator 10 and the engine 1 after the predetermined time has elapsed from stopping circulation of the water coolant. Therefore, the failure determination can be carried out even if the engine 1, which has not completely been warmed up, is turned off for a sufficiently long time.

According to the embodiment described above, deterioration in the insulation performance of the heat accumulator 10 can be determined according to the water coolant temperatures in the engine 1 and the heat accumulator 10 after the predetermined time has elapsed from stopping circulation of the water coolant.

The Fourth Exemplary Embodiment

The following discussion explains the differences between the third embodiment and the present embodiment. In the third embodiment, the determination of deterioration in the insulation performance is carried out according to the water coolant temperatures in the heat accumulator 10 and the engine 1 when the predetermined time elapses after the engine 1 is turned off or the engine preheating control is ended. In the fourth embodiment, on the other hand, determination of an abnormality in the insulation performance of the heat accumulator 10 or the heater 32 is carried out according to a driving history of the heater 32 when a predetermined time elapses after the engine 1 is turned off or the engine preheating control is ended.

In addition, it is not necessary to measure the water coolant temperature with the in-heat accumulator water coolant temperature sensor 28 and the in-engine water coolant temperature sensor 29 according to the fourth embodiment.

Though the present embodiment has adopted different objects and a method for the failure determination compared with the first embodiment, the engine 1 and a basic configuration of the other hardware are common to those of the first embodiment. Therefore, explanation of them has been omitted.

Meanwhile, in the heat accumulator 10 applied to the present embodiment, heat leaks out, though it is a small amount. If the engine has not been started for a long period of time, the water coolant temperature in the heat accumulator 10 drops. Therefore, if starting the engine is attempted after the long period of time, a sufficient effect of supplying heat cannot be achieved. If the water coolant, whose temperature has dropped in the heat accumulator, is heated at this time, it allows for circulating warmed coolant water and supplying heat to the engine 1.

However, the heater 32 is automatically energized and starts heating if the water coolant temperature in the heat accumulator 10 is equal to or lower than a predetermined temperature. Therefore, if the insulation performance of the heat accumulator 10 deteriorates which results in a more rapid than usual drop in temperature of the water coolant after the engine 1 is turned off, the heater 32 consumes more electric power. On the other hand, the battery 30 supplies electric power not only to the heater 32 but also to a starter motor (not shown). Therefore, if electric power for the starter motor is used to heat the water coolant when the engine 1 is started, start performance of the engine 1 may deteriorate.

In the present embodiment, electric power which the heater 32 needed to heat the water coolant, or an energize time of the heater 32, is detected when a predetermined time elapses after the engine 1 is turned off or the engine preheating control is ended. Then, to obviate the problem mentioned above, the failure determination is carried out by comparing the detected value with a value calculated in advance which the heat accumulator 10 normally consumes if operating properly. In the present embodiment as described above, the failure determination can be carried out without using a sensor for measuring the water coolant temperature since determination of the insulation performance is carried out according to electric power consumption or energize time of the heater 32.

Figure 9:
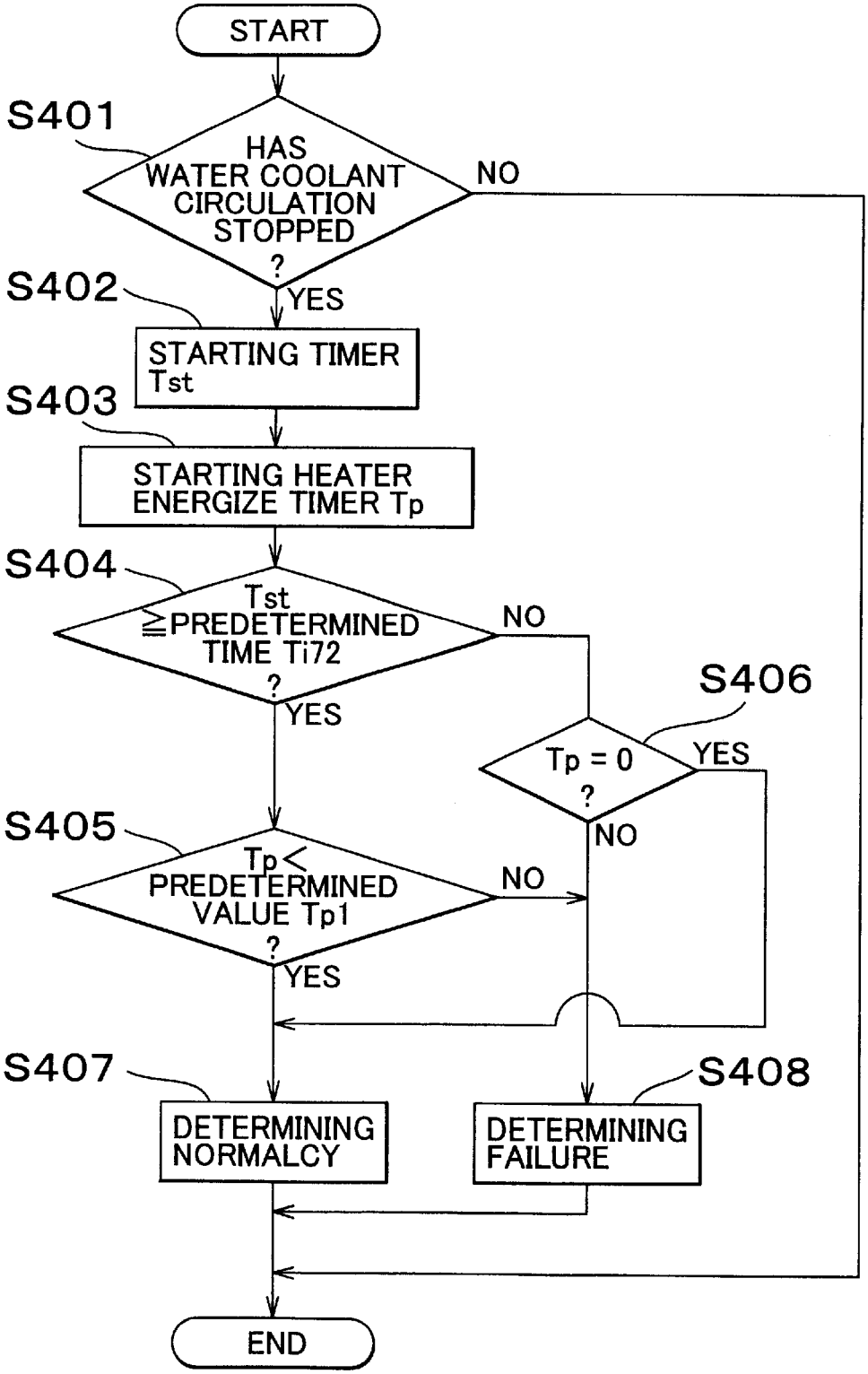
FIG. 9 is a flow chart showing the flow of a failure determination according to a fourth exemplary embodiment of the invention.

The following discussion explains the control flow when the failure determination is carried out. FIG. 9 is a flow chart showing the flow of the failure determination.

The failure determination control is carried out after the engine preheating control is carried out or the engine 1 is turned off.

At step S401, the ECU 22 determines whether or not a condition of carrying out the failure determination control is met. The condition is based on whether the coolant circulation stops, which occurs when turning off the engine 1 or when ending the engine preheating control. The water coolant temperatures in the heat accumulator 10 and the engine 1 are approximately the same immediately after the engine 1 is turned off or the engine preheating control is ended.

If the determination is affirmative at step S401, the routine proceeds to step S402, and if negative, it ends the present routine.

At step S402, the ECU 22 starts a timer for counting elapsed time from turning off the engine 1 or ending the engine preheating control.

At step S403, the ECU 22 initializes (sets to zero) a timer for counting the energize time of the heater 32 from turning off the engine 1 or ending the engine preheating control.

At step S404, the ECU 22 determines whether or not the count time Tst of the timer is equal to or longer than the predetermined time Ti72 (72 hours, for example). If the determination is affirmative, the CPU 22 proceeds to step S405, and if negative, it proceeds to step S406.

At step S405, the ECU 22 determines whether or not count time Tp of the heater energize timer is shorter than a predetermined time Tp1. If the determination is affirmative, the routine proceeds to step S407, and if negative, it proceeds to step S408.

At step S406, the ECU 22 determines whether or not the count time Tp of the heater energize timer is zero, in other words, the heater 32 has not been energized. If the determination is affirmative, the routine proceeds to step S407, and if negative, it proceeds to step S408.

The determination condition at step S406 may be "whether or not the count time Tp of the timer is equal to or longer than a predetermined time" instead of "whether or not the count time Tp is equal to zero".

Figure 10:
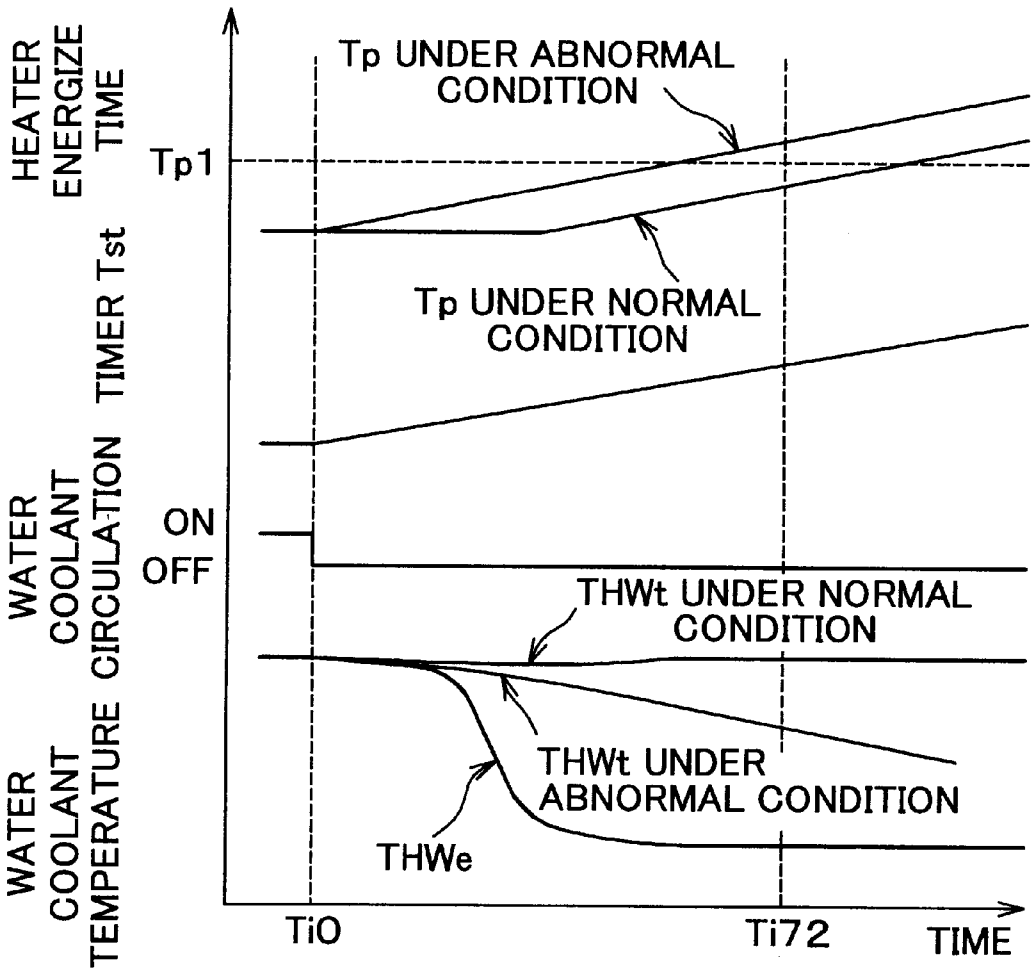
FIG. 10 is a time chart showing transitions of an in-heat accumulator water coolant temperature THWt, an in-engine water coolant temperature THWe, and a heater energizing time according to the fourth exemplary embodiment of the invention.

FIG. 10 is a time chart showing transitions of the in-engine water coolant temperature THWe, the in-heat accumulator water coolant temperature THWt, and the heater energize time Tp until the predetermined time Ti72 elapses after circulation of the water coolant is stopped. The temperature of the water coolant accumulated in the heat accumulator 10 is approximately the same as that of the water coolant accumulated in the engine 1 immediately after the water coolant is supplied to the engine 1 from the heat accumulator 10 or the engine 1 is turned off. If the engine is not started after this, heat is emitted into the outside air, so that the water coolant temperature in the engine 1 drops. On the other hand, heat leaks out, though it is a small amount, from the interior of the heat accumulator 10. However, the heat accumulator 10 can keep the water coolant temperature equal to or higher than a required temperature according to emission performance if elapsed time is within the predetermined time Ti72 (72 hours, for example).

However, if the insulation performance of the heat accumulator 10 deteriorates, the temperature in the heat accumulator 10 drops rapidly. At this time, the heater 32 heats the water coolant, and the heater energize timer is actuated to count simultaneously while the heater 32 is turned on. Therefore, it can be determined that there is an abnormality in the insulation performance if either one of the following two conditions is met before the predetermined time Ti72 elapses after the engine 1 is turned off or the engine preheating control is ended. The first condition is that the heater energize timer is counted even a little, and the second condition is that the elapsed time is equal to or longer than a predetermined time.

In addition, the energize time of the heater 32 becomes longer if there is an abnormality in the insulation performance even when the predetermined time Ti72 elapses after the engine 1 is turned off or the engine preheating control is ended. Therefore, it can be determined that there is an abnormality in the insulation performance if a count of the heater energize timer is equal to or greater than the predetermined time Tp1.

At steps S407 and S408, determinations similar to the ones described above are carried out. At these steps, deterioration in the insulation performance of the heat accumulator 10 or a failure of the heater 32 can be determined.

If it is determined that there is a failure, a warning light (not shown) may be turned on to alert a user. In addition, the ECU 22 may be programmed so that it does not carry out the engine preheating control again.

In a conventional engine, a failure determination to determine deterioration in the insulation performance of the heat accumulating device is carried out on the assumption that the water coolant is accumulated in the heat accumulator 10 in conditions where the water coolant has completely been warmed up. In addition, measuring the water coolant temperature is necessary.

Therefore, a sensor for measuring the water coolant temperature is provided in the heat accumulator. However, the insulation performance should be considered at a point where the sensor is provided.

According to the engine with the heat accumulating device relating to the present embodiment, on the other hand, the failure determination is carried out in consideration of the energize time of the heater 32 counted when the predetermined time elapses after circulation of the water coolant is stopped. Therefore, the failure determination can be carried out without using a temperature sensor.

According to the present embodiment described above, deterioration in the insulation performance of the heat accumulator 10 can be determined according to the energize time of the heater 32 counted when the predetermined time elapses after circulation of the water coolant is stopped.

Though the failure determination is carried out according to the energize time of the heater 32 in the present embodiment, it may be carried out according to electric power consumption or the amount of electric current of the heater.

The Fifth Exemplary Embodiment

The following routine explains the differences between the fourth embodiment and the present embodiment. In the fourth embodiment, determination of an abnormality in the insulation performance is carried out according to the energize time of the heater 32 counted when the predetermined time elapses after the engine 1 is turned off or the engine preheating control is ended. In the fifth embodiment, on the other hand, determination of an abnormality in the insulation performance or the heater 32 is carried out according to time from turning off the engine 1 or ending the engine preheating control to activation of the heater 32.

Though the present embodiment has adopted different objects and a method for the failure determination compared with the first embodiment, the engine 1 and a basic configuration of the other hardware can be common to those of the first embodiment. Therefore, explanation of them has been omitted.

Meanwhile, in the heat accumulator 10 applied to the present embodiment, heat leaks out, though it is a small amount. If the engine has not been started for a long time period, the water coolant temperature in the heat accumulator 10 drops. Therefore, if starting the engine is attempted after the long period, a sufficient effect of supplying heat cannot be achieved. If the water coolant, whose temperature has dropped in the heat accumulator, is heated at this time, it allows for circulating warmed water and supplying heat to the engine 1.

However, the heater 32 is automatically energized and starts heating if the water coolant temperature is equal to or lower than a predetermined temperature. Therefore, if the insulation performance of the heat accumulator 10 deteriorates which results in a rapid drop in temperature of the water coolant in the accumulator 10 after the engine 1 is turned off, the heater 32 consumes more electric power. On the other hand, the battery 30 supplies electric power to not only the heater 32 but also to a starter motor (not shown). Therefore, if electric power for the starter motor is used to heat the water coolant when the engine 1 is started, start performance of the engine 1 may deteriorate.

In the present embodiment, a time period from turning off the engine 1 or ending the engine preheating control to the start of heating the water coolant by the heater 32 is detected. Then, to obviate the problem mentioned above, the failure determination is carried out by comparing the detected time with a predetermined time which elapses between a time when the coolant circulation stops and the time when the heater 32 first starts heating the water coolant when the heat accumulator 10 is operating under normal conditions. In the present embodiment as described above, the failure determination can be carried out without using a sensor for measuring the water coolant temperature since determination of the insulation performance is carried out according to the time that elapses before the heater 32 first starts heating the water coolant.

Figure 11:
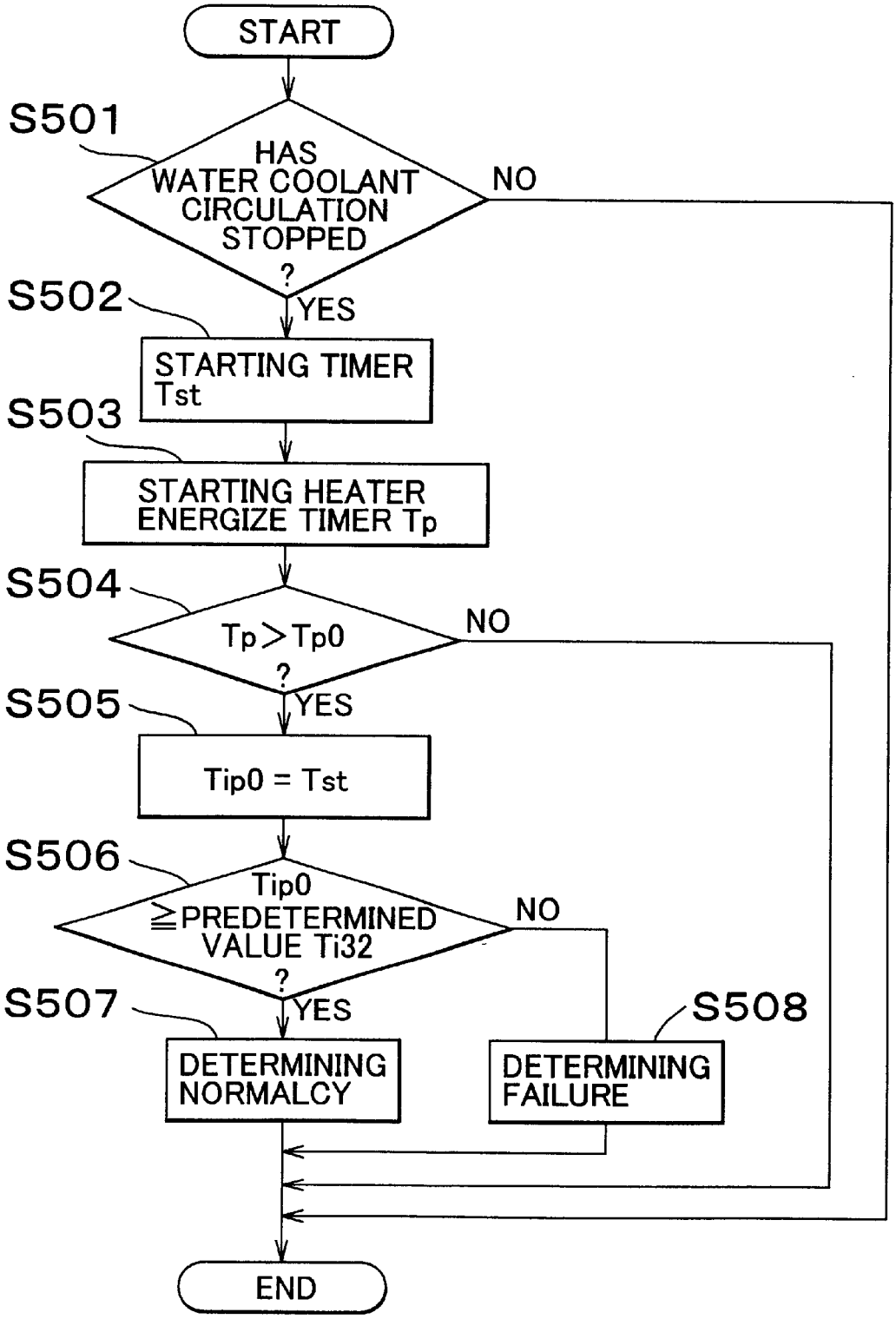
FIG. 11 is a flow chart showing the flow of a failure determination according to a fifth exemplary embodiment of the invention.

The following discussion explains the control flow when the failure determination is carried out. FIG. 11 is a flow chart showing the flow of the failure determination.

The failure determination control is carried out after the engine preheating control is carried out or the engine 1 is turned off.

At step S501, the ECU 22 determines whether or not a condition of carrying out the failure determination control is met. The condition is whether coolant circulation has stopped, which occurs when turning off the engine 1 or when ending the engine preheating control. The water coolant temperatures in the heat accumulator 10 and the engine 1 are approximately the same immediately after the engine 1 is turned off or the engine preheating control is ended.

If the determination is affirmative at step S501, the routine proceeds to step S502, and if negative, it ends the present routine.

At step S502, the ECU 22 starts a timer Tst for counting elapsed time from turning off the engine 1 or ending the engine preheating control.

At step S503, the ECU 22 initializes a timer Tp for counting the energize time of the heater 32 from turning off the engine 1 or ending the engine preheating control.

At step S504, the ECU 22 determines whether or not the count time Tp of a heater energize timer is greater than a predetermined value Tp0. The predetermined value Tp0 is a value equal to one count of the heater energize timer. In other words, the ECU 22 determines whether or not the heater 32 has heated the water coolant even once. If the determination is affirmative, the routine proceeds to step S505, and if negative, it ends the present routine.

At step S505, the count time Tst of the timer is input at post-circulation energizing start time Tip0.

At step S506, the ECU 22 determines whether or not the post-circulation energize start time Tip0 is equal to or longer than a predetermined time Ti32 (32 hours, for example). If the determination is affirmative, the routine proceeds to step S507, and if negative, it proceeds to step S508.

Figure 12:
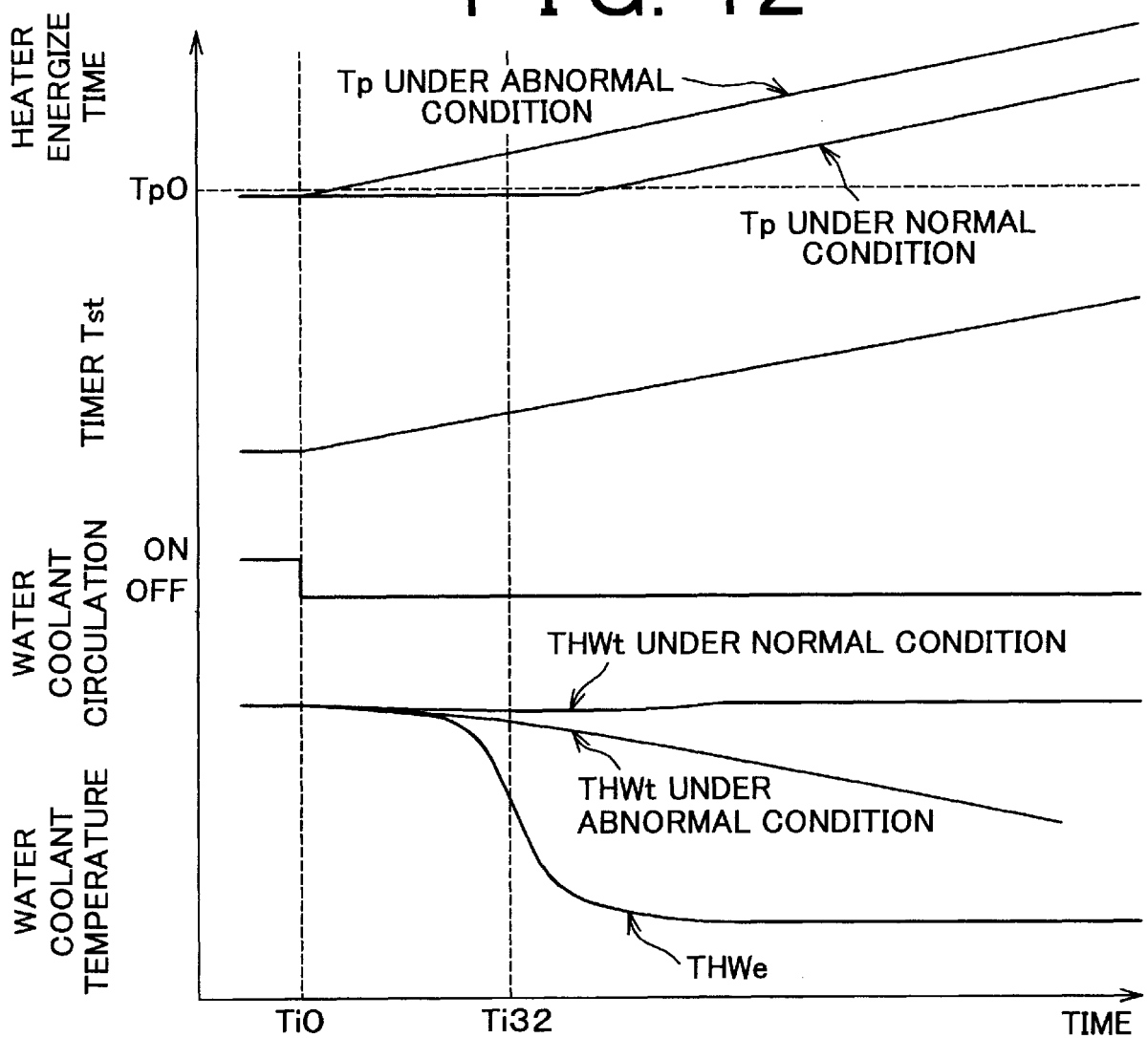
FIG. 12 is a time chart showing transitions of an in-heat accumulator water coolant temperature THWt, an in-engine water coolant temperature THWe, and a heater energizing time according to the fifth exemplary embodiment of the invention.

FIG. 12 is a time chart showing transitions of the in-heat accumulator water coolant temperature THWt, the in-engine water coolant temperature THWe, and the heater energize time Tp after circulation of the water coolant is stopped. The temperature of the water coolant accumulated in the heat accumulator 10 is approximately the same as that of the water coolant accumulated in the engine 1 immediately after the water coolant is supplied to the engine 1 from the heat accumulator 10 or the engine 1 is turned off. If the engine is not started after this, heat is emitted into the outside air, so that the water coolant temperature in the engine 1 drops. On the other hand, heat slowly leaks out from the interior of the heat accumulator 10. However, under normal operation, the water coolant temperature is kept equal to or higher than a required temperature without heating by the heater 32 if the elapsed time is within the predetermined time Ti32 (32 hours, for example).

However, if the insulation performance of the heat accumulator 10 deteriorates, the temperature in the heat accumulator 10 drops rapidly. Then, the heater 32 heats the water coolant before the predetermined time Ti32 elapses, and the heater energize timer is counted simultaneously. Therefore, it can be determined that the insulation performance is normal if the time from turning off the engine 1 or ending the engine preheating control to the start of heating the water coolant by the heater 32 is longer than the predetermined time Ti32.

At steps S507 and S508, determinations similar to the ones described above are carried out. At these steps, it can be determined that there is a failure when the insulation performance of the heat accumulator 10 deteriorates or there is a failure of the heater 32.

If it is determined that there is a failure, a warning light (not shown) may be turned on to alert a user. In addition, the ECU 22 may be programmed not to carry out the engine preheating control.

In a conventional engine, a failure determination to determine deterioration in the insulation performance of the heat accumulating device is carried out on the assumption that the water coolant is accumulated in the heat accumulator 10 in conditions where the water coolant has completely been warmed up. In addition, measuring the water coolant temperature is necessary.

Therefore, a sensor for measuring the water coolant temperature is provided in the heat accumulator. However, the insulation performance is only considered at a point where the sensor is provided.

According to the engine with the heat accumulating device relating to the present embodiment, on the other hand, the failure determination is carried out in consideration of the time from stopping the circulation of the water coolant to activation of the heater 32. Therefore, the failure determination can be carried out without using a temperature sensor.

According to the present embodiment described above, deterioration in the insulation performance of the heat accumulator 10 can be determined according to the time from stopping the circulation of the water coolant to activation of the heater 32.

The Sixth Exemplary Embodiment

The following discussion explains the differences between the third embodiment and the present exemplary embodiment. In the third embodiment, the determination of deterioration in the insulation performance of the heat accumulator 10 is carried out according to the water coolant temperatures in the heat accumulator 10 and the engine 1 when the predetermined time elapses after the engine 1 is turned off or the engine preheating control is ended. In the sixth embodiment, on the other hand, deterioration in the insulation performance of the heat accumulator 10 or a failure of the heater is determined according to only the water coolant temperature in the heat accumulator 10, when the predetermined time elapses after the engine 1 is turned off or the engine preheating control is ended.

Though the present embodiment has adopted different objects and a method for the failure determination compared with the first embodiment, the engine 1 and a basic configuration of the other hardware are common to those of the first embodiment. Therefore, explanation of them has been omitted.

Meanwhile, in a system according to the present embodiment, in other words, a system for exchanging heat between the engine 1 and the heat accumulator 10 by water coolant circulating in both these parts, if the insulation performance of the heat accumulator 10 deteriorates, the water coolant temperature in the engine 1 gradually drops as the temperature of the water coolant in the heat accumulator 10 gradually drops after the engine is turned off or the engine preheating control is ended. If starting the engine 1 is delayed for some reason, the engine 1 needs to be heated again since the temperature of the engine 1, which has once been heated, drops. At this time, the water coolant temperature in the heat accumulator 10 has dropped, so that a sufficient effect of heating the engine 1 by circulating the water coolant cannot be achieved. In a conventional system under the above-mentioned condition, a user can learn of a drop in temperature of the water coolant by a temperature, which is indicated on a temperature indicating panel provided in a compartment, according to signals from a temperature sensor provided in the heat accumulator 10.

However, if there is a failure of the heater 32 that heats the water coolant in the heat accumulator 10, the water coolant temperature in the heat accumulator 10 continues to slowly drop. In a conventional art, deterioration in the insulation performance of the heat accumulator 10 can be determined, if the temperature extremely drops. However, a failure determination according to the slight drop in the temperature cannot be carried out.

According to the present embodiment, the failure determination is carried out according to the water coolant temperature in the heat accumulator 10 when the predetermined time elapses after the engine 1 is turned off or the engine preheating control is ended. The engine 1 emits heat to outside or into the atmosphere after it is turned off, so that the temperature of the engine 1 drops gradually. On the other hand, the heat accumulator 10 accumulates and insulates the water coolant whose temperature has risen during running of the engine 1. If the engine preheating control is carried out under this condition, the temperature in the heat accumulator 10 drops since the water coolant, whose temperature has dropped in the engine 1, flows into the heat accumulator 10 in addition to supplying the heated water coolant to the engine 1 from the heat accumulator 10. Then the water coolant temperature in the heat accumulator 10 becomes approximately equal to that of the water coolant in the engine 1. On the other hand, the water coolant temperatures in the heat accumulator 10 and the engine 1 are approximately the same immediately after the engine 1 is turned off. If the engine is not started when the water coolant temperatures in the heat accumulator 10 and the engine 1 are approximately the same, the water coolant temperature in the engine 1 drops again.

If there is not an abnormality in the heat accumulator 10 when a predetermined time elapses after circulation of the water coolant is stopped, the water coolant in the heat accumulator 10 will be maintained at a predetermined temperature guaranteed when the insulation performance is normal. However, if the insulation performance of the heat accumulator 10 is deteriorating, the water coolant temperature in the heat accumulator 10 becomes lower than the predetermined temperature. If there are abnormalities in both the heat accumulator 10 and the heater 32, the temperature drops further.

If the insulation performance of the heat accumulator 10 deteriorates and there is a failure of the heater 32, the water coolant temperature in the heat accumulator 10 becomes lower than the predetermined temperature when the predetermined time elapses after the engine 1 is stopped or the engine preheating control is ended. Therefore, the failure determination is possible by measuring the water coolant temperature in the heat accumulator 10.

Figure 13:
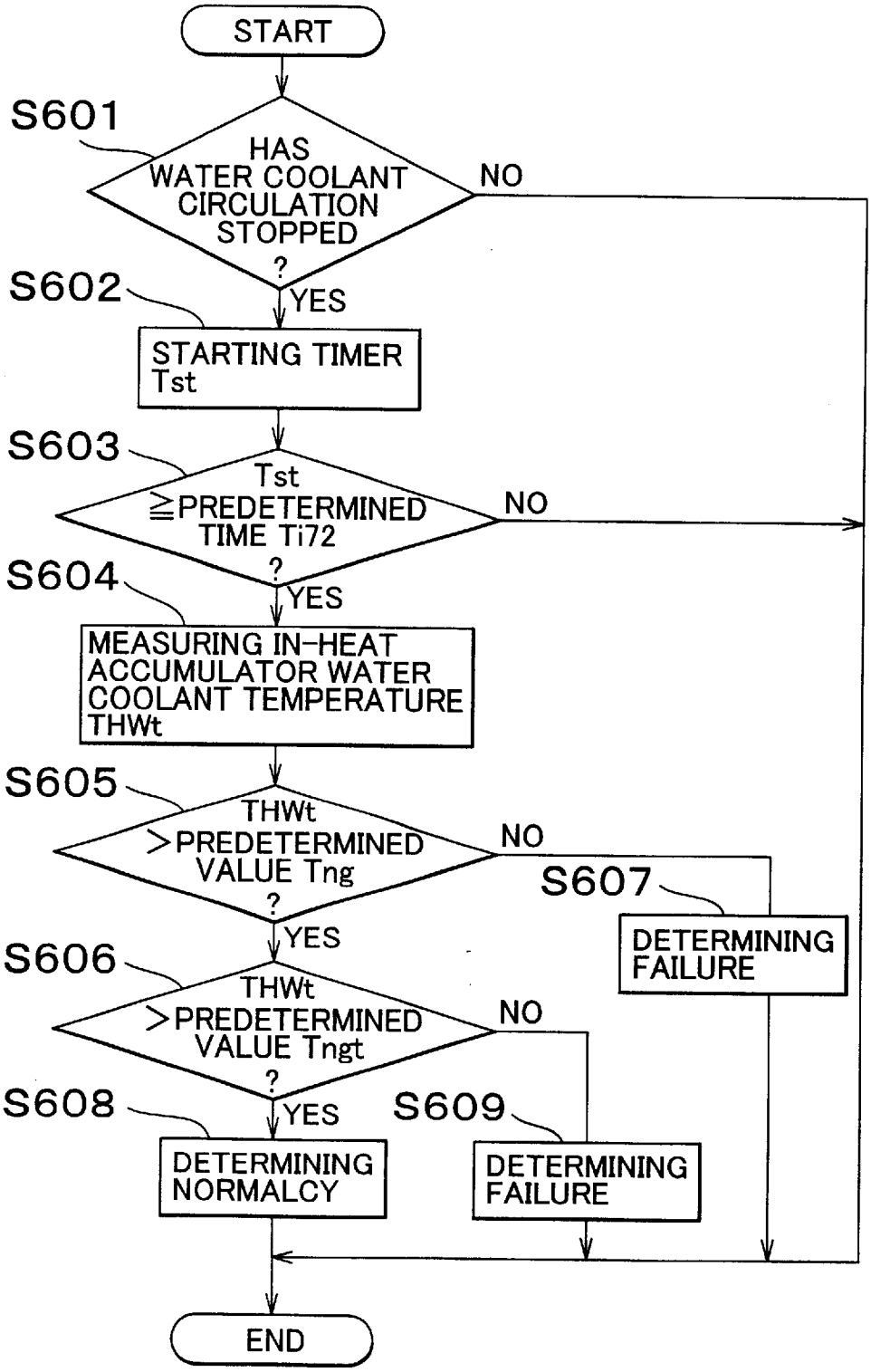
FIG. 13 is a flow chart showing the flow of a failure determination according to a sixth exemplary embodiment of the invention.

The following explains the control flow when the failure determination is carried out. FIG. 13 is a flow chart showing the flow of the failure determination.

The failure determination control is carried out after the coolant circulation ends which occurs when the engine preheating control is completed or when the engine 1 is turned off.

If the determination is affirmative at step S601, the routine proceeds to step S602, and if negative, it ends the present routine.

At step S602, the ECU 22 starts a timer Tst for counting elapsed time from turning off the engine 1 or ending the engine preheating control.

At step S603, the ECU 22 determines whether or not the count time Tst of the timer is equal to or longer than the predetermined time Ti72 (72 hours, for example). If the determination is affirmative, the routine proceeds to step S604, and if negative, it ends the present routine.

At step S604, the water coolant temperature THWt in the heat accumulator 10 is measured. The ECU 22 stores the output signals from the in-heat accumulator water coolant temperature sensor 28 into the RAM 353.

At step S605, the ECU 22 determines whether or not the water coolant temperature THWt in the heat accumulator 10 is higher than a predetermined value Tng. If the determination is affirmative, the routine proceeds to step S606, and if negative, it proceeds to step S607.

Figure 14:
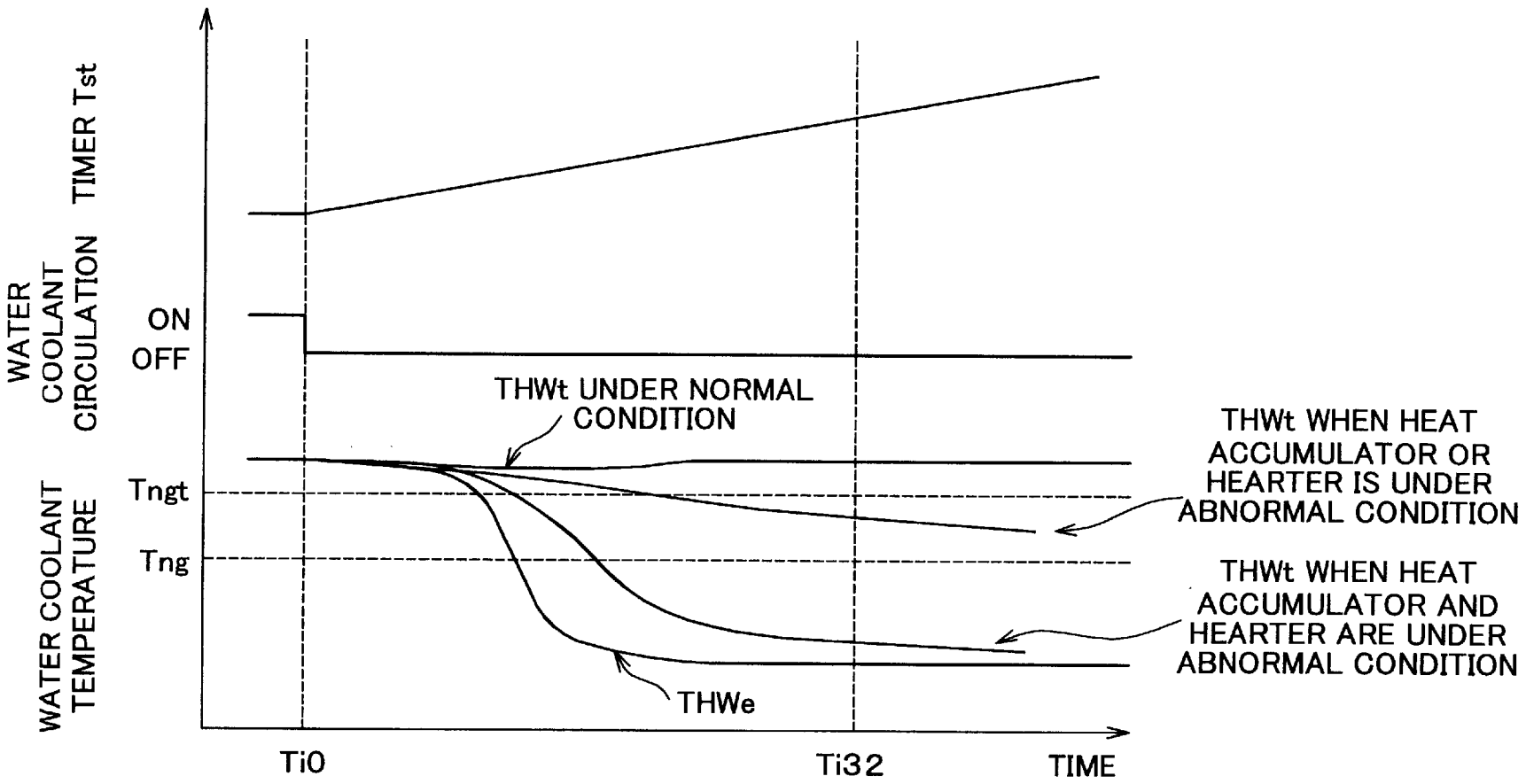
FIG. 14 is a time chart showing transitions of an in-heat accumulator water coolant temperature THWt and an in-engine water coolant temperature THWe according to the sixth exemplary embodiment of the invention.

FIG. 14 is a time chart showing transitions of the in-engine water coolant temperature THWe and the in-heat accumulator water coolant temperature THWt up to the time when the predetermined time Ti32 elapses after circulation of the water coolant is stopped. The predetermined value Tng is a temperature which drops when the insulation performance of the heat accumulator 10 deteriorates and there is an abnormality in the heater 32, and it can be calculated through experimentation. At step S607 as described above, it is determined that there are abnormalities in the heat accumulator 10 and the heater 32.

At step S606, the ECU 22 determines whether or not the water coolant temperature THWt in the heat accumulator 10 is higher than a predetermined value Tngt. If the determination is affirmative, the routine proceeds to step S608, and if negative, it proceeds to step S609.

The predetermined value Tngt is a temperature which is maintained when both the heat accumulator 10 and the heater 32 are normal, and it can be calculated through experimentation. At step S609, the water coolant temperature is between the predetermined value Tng and the predetermined value Tngt. Under this condition, it can be determined that there is an abnormality either in the heat accumulator 10 or in the heater 32.

According to the present embodiment, the predetermined value Tng and the predetermined value Tngt may be determined according to the water coolant temperature immediately after the engine 1 is supplied with the water coolant from the heat accumulator 10 or the engine 1 is turned off. In this way, the failure determination can be carried out even if the water coolant temperature is low when the engine 1 is turned off before being warmed up completely.

If it is determined that there is a failure, a warning light (not shown) may be turned on to alert a user. In addition, the ECU 22 may be programmed so that it does not carry out the engine preheating control again.

In a conventional engine, a failure determination to determine deterioration in the insulation performance of the heat accumulating device is carried out on the assumption that the water coolant is accumulated in the heat accumulator 10 in conditions where the water coolant has completely been warmed up. In addition, the failure determination is carried out when the temperature changes extremely.

However, when the engine 1 is turned off immediately after the engine 1 is started and before the water coolant temperature sufficiently rises, a high-temperature water coolant cannot be introduced into the heat accumulator 10. Therefore, an accurate determination result cannot be obtained by the failure determination carried out only according to the temperature in the heat accumulator 10 at this time. In addition, when there is a drop in temperature of the water coolant because of a failure of the heater, the drop is slight, so that the failure determination cannot be carried out at an early stage in this case.

According to the engine with the heat accumulating device relating to the present embodiment, on the other hand, the failure determination is carried out in consideration of the temperature which the water coolant in the heat accumulator 10 is expected to reach when the predetermined time elapses after circulation of the water coolant is stopped. Therefore, the failure determination can be carried out even if the engine 1, which has not completely been warmed up, is turned off. Furthermore, a failure can be determined even if there is a slight drop in temperature.

According to the present embodiment described above, deterioration in the insulation performance of the heat accumulator 10 and a failure of the heater 32 can be determined according to the water coolant temperature in the heat accumulator 10 when the predetermined time elapses after circulation of the water coolant is stopped.

The Seventh Exemplary Embodiment

According to the present embodiment, the failure determination is carried out according to any of the embodiments described above while also considering the temperature of the outside (ambient) air. To measure the outside air temperature, an outside air temperature sensor (not shown) is used. Though the seventh embodiment has adopted different objects and a method for the failure determination compared with the first embodiment, the engine 1 and a basic configuration of the other hardware are common to those of the first embodiment. Therefore, explanation of them has been omitted.

As the water coolant accumulated in the heat accumulator 10 emits heat, though it is a small amount, and the water coolant temperature drops. The lower the outside air temperature becomes, the more quickly the heat is emitted from the water coolant in the accumulator 10 and the engine 1. Therefore, when the outside air temperature is low, the water coolant temperature in the heat accumulator 10 drops more rapidly even if the heat accumulator 10 is normal. If the failure determination is carried out under this condition, it can be difficult to determine if the cause of a drop in temperature of the water coolant is due to a low outside air temperature, or due to deterioration in the insulation performance or a failure of the heater 32.

In the present embodiment, the determination conditions, used in each embodiment described above, are corrected according to the outside air temperature.

Figure 15:
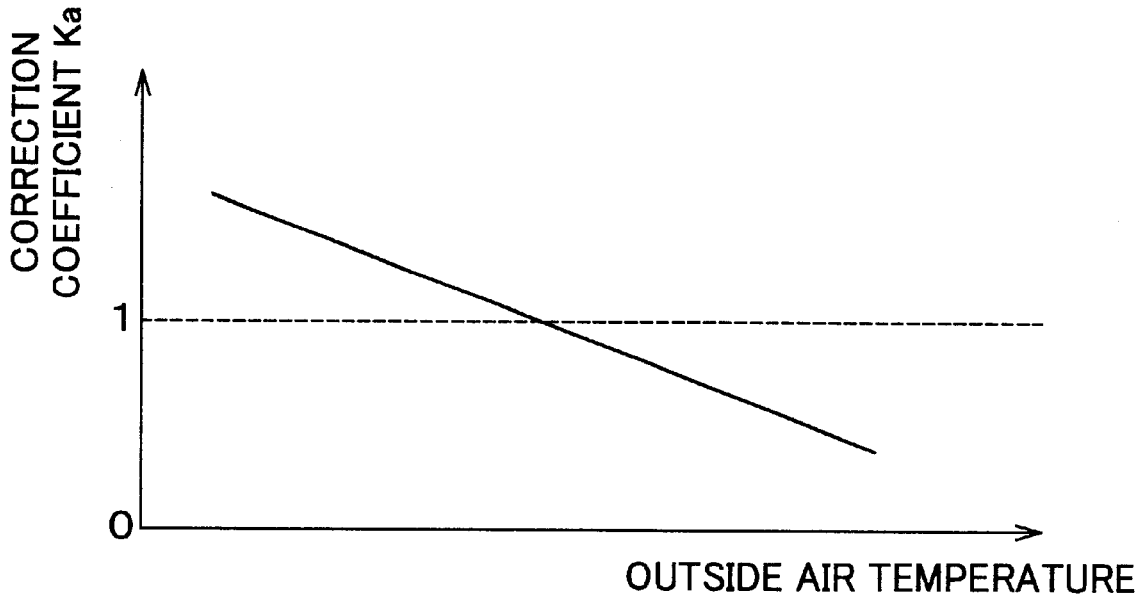
FIG. 15 is a graph showing the relation between an outside air temperature and a correction coefficient Ka according to a seventh exemplary embodiment of the invention.

FIG. 15 is a graph showing the relation between the outside air temperature and a correction coefficient Ka. The lower the outside air temperature becomes, the larger the rate of the drop in temperature of the water coolant becomes. Therefore, the temperatures of each determination condition are corrected to lower ones by increasing the correction coefficient Ka as the ambient temperature drops.

The correction coefficient Ka is used by multiplying it by a value such as the predetermined temperature Te, a proof temperature of the heat accumulator 10, the predetermined value Tt1, the predetermined value Tng, or the predetermined value Tngt.

If the outside air temperature is reflected in the determination conditions as described above, determination conditions corresponding to the outside air temperature can be set. Therefore, the failure determination can be carried out with higher accuracy.

The Eighth Exemplary Embodiment

According to the present embodiment, the failure determination and heating the water coolant by the heater 32 are prohibited when a running time of the engine 1 is short.

When the engine 1 is turned off immediately after the engine 1 is started and before the water coolant temperature rises, a high-temperature water coolant cannot be introduced into the heat accumulator 10. Therefore, the water coolant in the heat accumulator 10 needs to be heated by the heater 32 to achieve the effect of supplying heat.

However, when the water coolant is heated, the heater 32 is supplied with electric power from the battery 30. Therefore, if the water coolant temperature is low in the heat accumulator 10, a great amount of electric power is consumed. The battery 30 supplies electric power to a starter motor (not shown) when the engine 1 is started. Therefore, if the electric power for the starter motor to start the engine 1 is used to heat the water coolant, start performance of the engine 1 may deteriorate.

In the present exemplary embodiment, heating the water coolant by the heater 32 is prohibited when there is a chance that the battery may run out, which makes starting the engine 1 difficult, to obviate the problem mentioned above. In addition, the failure determination is also prohibited when heating the water coolant by the heater 32 is prohibited to avoid a wrong determination.

Figure 16:
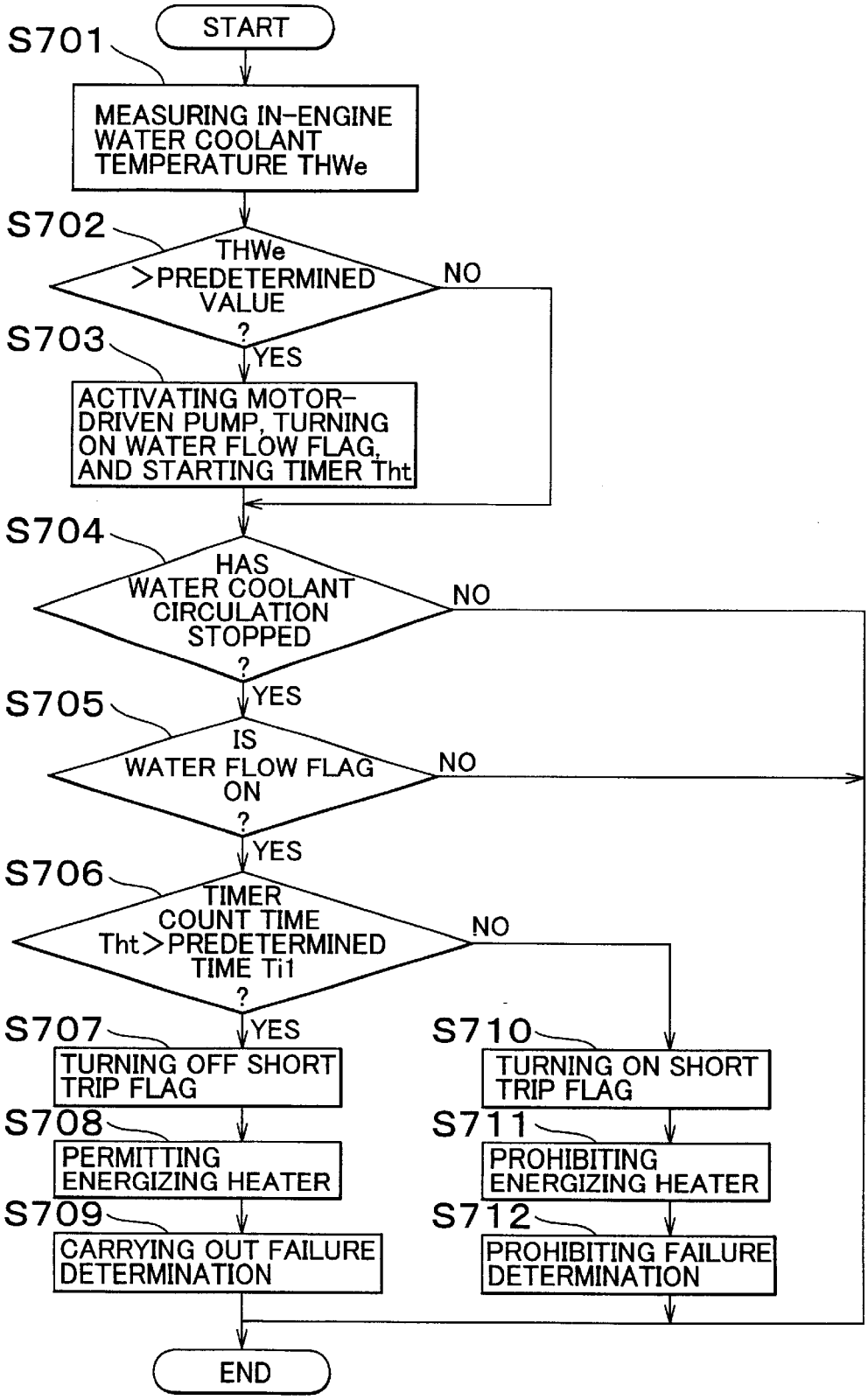
FIG. 16 is a flow chart showing the flow of determining whether to energize a heater according to an eighth exemplary embodiment of the invention.

FIG. 16 is a flow chart showing the flow of determining whether to energize the heater 32 or not by calculating a time for which the water coolant had been accumulated in the heat accumulator 10.

The ECU 22 activates the motor-driven water pump 12 to introduce the water coolant into the heat accumulator 10, when the water coolant in the engine 1 reaches a temperature that is equal to or higher than a predetermined temperature. The water coolant, which has been introduced into the heat accumulator 10, pushes a low-temperature water coolant, which has remained in the heat accumulator 10, out of the water coolant extracting tube 10*d*. Then the water coolant temperature in the heat accumulator 10 rises gradually. If an introducing time to introduce the water coolant into the heat accumulator 10 can sufficiently be secured, a high-temperature water coolant can be accumulated in the heat accumulator 10.

In the present embodiment, a heater energize determination can be carried out not only after the engine 1 is turned off but also when the engine 1 is running.

At step S701, the water coolant temperature THWe in the engine 1 is measured. The ECU 22 stores the output signals from the in-engine water coolant temperature sensor 29 in the RAM 353.

At step S702, the ECU 22 determines whether or not the water coolant temperature THWe in the engine 1 is higher than a predetermined value. The predetermined value is a required temperature according to emission performance, to which the engine 1 can be warmed up, when the water coolant is circulated to supply heat and the engine 1 is at rest.

If the determination is affirmative at step S702, the routine proceeds to step S703, and if negative, it proceeds to step S704.

At step S703, the ECU 22 starts a timer for measuring a water coolant introducing time Tht in addition to activating the motor-driven water pump 12 to circulate the water coolant into the heat accumulator 10. The timer counts time for which the motor-driven pump 12 has been driven. Furthermore, the ECU 22 turns on a water flow flag which indicates that introducing the water coolant into the heat accumulator 10 has been carried out.

At step S704, the ECU 22 determines whether or not circulation of the water coolant has been stopped. The determination condition at this step is "whether or not the engine 1 has been turned off" or "whether or not the motor-driven pump 12 has been turned off".

If the determination is affirmative at step S704, the routine proceeds to step S705, and if negative, it ends the present routine for the moment.

At step S705, the ECU 22 determines whether the water flow flag is "ON" or not. If the determination is affirmative, the routine proceeds to step S706 since the water coolant has been introduced into at least the heat accumulator 10. Then the ECU 22 determines whether or not the amount of the water coolant, which has been introduced into the heat accumulator 10, is sufficient at step S706. If the determination at step S705 is negative, on the other hand, the ECU 22 ends the present routine without determining the state of the water coolant temperature in the heat accumulator 10, since the water coolant has not sufficiently been introduced into the heat accumulator 10.

At step S706, the ECU 22 determines whether or not the count time Tht of the timer is longer than the predetermined time Ti1. The shorter the count time Tht of the timer becomes, the smaller the amount of water coolant the ECU 22 introduces into the heat accumulator 10. Therefore, the water coolant temperature in the heat accumulator 10 becomes lower. If the water coolant temperature in the heat accumulator 10 has not risen to a temperature under which the effect of supplying heat can be achieved, the water coolant needs to be heated by the heater 32. However, if the heater 32 heats the water coolant for a long time, it needs a larger amount of electricity than usable electricity which the battery 30 has been charged with. In this case, heating the water coolant by the heater 32 is prohibited.

The predetermined time Ti1 may be determined according to the amount of electricity which the battery 30 has been charged with. In this case, a relation between the count time Tht of the timer and the amount of electricity necessary for heating the water coolant is calculated, and it is stored in the ROM 352 as a map. Then the amount of electricity which the battery 30 has been charge with is detected, and the predetermined time Ti is derived by substituting the detected amount of electricity in the map.

If the determination is affirmative at step S706, the routine proceeds to step S707, and if negative, it proceeds to step S710.

At step S707, the ECU 22 determines that the engine 1 has been running for long enough to store a high-temperature water coolant in the heat accumulator 10 (hereinafter referred to as "normal trip"). In this case, the ECU 22 has introduced the water coolant into the heat accumulator 10 for a long time, which indicates that the high-temperature water coolant has been accumulated in the heat accumulator 10. Therefore, electric power, which the heater 32 consumes to keep the water coolant temperature necessary for starting the engine 1 next time, is small. At step S707, a short trip flag, which indicates that the engine 1 has not been running for long enough to store the high-temperature water coolant in the heat accumulator 10 (hereinafter referred to as "short trip"), is turned off.

At step S708, the ECU 22 permits energizing of the heater 32.

At step S709, a determination similar to the one in any of the embodiments described above is carried out.

At step S710, the ECU 22 determines that the engine 1 has not been running for long enough to store a high-temperature water coolant in the heat accumulator 10, and turns on the short trip flag. In this case, the ECU 22 has not introduced the water coolant into the heat accumulator 10 for a long time, so that the temperature of the water coolant accumulated in the heat accumulator 10 is low. Therefore, the heater 32 consumes a lot of electric power to heat the water coolant to the temperature necessary for starting the engine 1 next time, so that the battery may run out.

At step S711, the ECU 22 prohibits energizing the heater 32. At this time, the ECU 22 shuts off a circuit to which the heater 32 is connected.

At step S712, the ECU 22 prohibits the failure determination. If the ECU 22 determines the short trip, it indicates that the water coolant temperature in the heat accumulator 10 is low. Furthermore, heating the water coolant by the heater 32 is prohibited at step S711, so that the failure determination is prohibited since a wrong determination may be carried out.

The heater 32, used in the present embodiment as described above, is capable of controlling its temperature independently. In other words, heating is carried out when needed without a temperature control carried out by the ECU 22. Therefore, when a low-temperature water coolant has been accumulated in the heat accumulator 10, the heater 32 heats the water coolant.

However, if electric power consumption of the heater 32 to heat the water coolant to a predetermined temperature is less than the amount of electricity which the battery 30 is charged with, the heater 32 heats the water coolant until the battery 30 runs out.

In the present embodiment, the water coolant is heated in consideration of the temperature of the water coolant accumulated in the heat accumulator 10 to avoid the problem described above. Therefore, start performance does not deteriorate, and the battery can be prevented from running out.

In the present embodiment described above, the heater 32 can heat the water coolant to the extent where there is no chance that the battery may run out.

The Ninth Exemplary Embodiment

The following discussion explains the differences between the eighth embodiment and the present exemplary embodiment. In the eighth embodiment, the normal trip or the short trip is determined according to whether or not the timer count time Tht is longer than the predetermined time Ti1. In the ninth embodiment, on the other hand, the normal trip or the short trip is determined according to the water coolant temperature in the heat accumulator 10.

Figure 17:
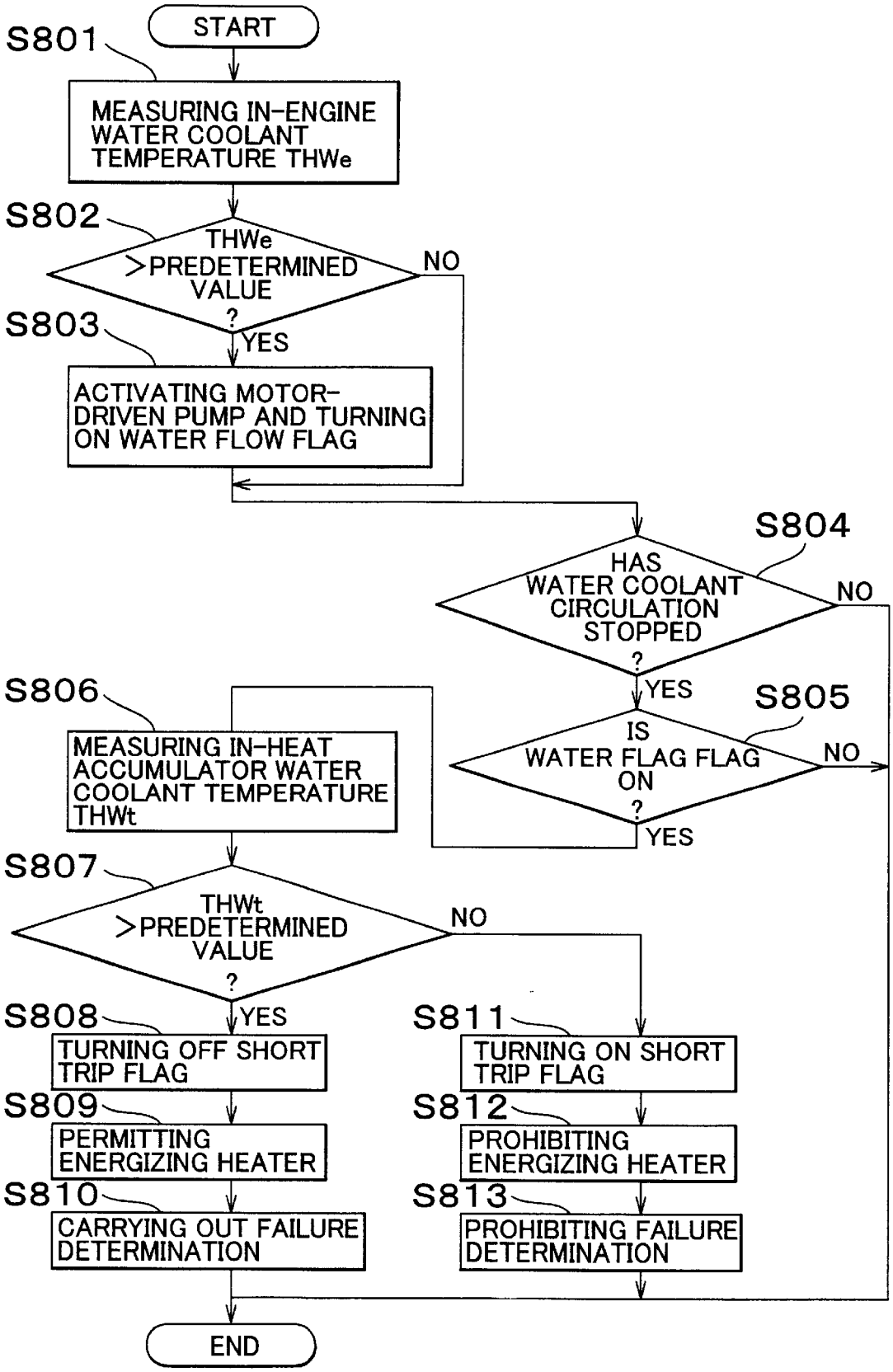
FIG. 17 is a flow chart showing the flow of determining whether to energize a heater according to a ninth exemplary embodiment of the invention.

FIG. 17 is a flow chart showing the flow of determining whether to energize the heater 32 or not according to the water coolant temperature in the heat accumulator 10.

In the present embodiment, a heater energize determination can be carried out not only after the engine 1 is turned off but also when the engine 1 is running.

At step S801, the water coolant temperature THWe in the engine 1 is measured. The ECU 22 stores the output signals from the in-engine water coolant temperature sensor 29 in the RAM 353.

At step S802, the ECU 22 determines whether or not the water coolant temperature THWe in the engine 1 is higher than a predetermined value. The predetermined value can be a required temperature according to emission performance, to which the engine 1 can be warmed up, when the water coolant is circulated to supply heat and the engine 1 is at rest.

If the determination is affirmative at step S802, the routine proceeds to step S803, and if negative, it proceeds to step S804.

At step S803, the ECU 22 turns on a water flow flag, which indicates that introducing the water coolant into the heat accumulator 10 has been carried out, in addition to activating the motor-driven water pump 12 to circulate the water coolant in the heat accumulator 10.

At step S804, the ECU 22 determines whether or not circulation of the water coolant has been stopped. The determination condition at this step is "whether or not the engine 1 has been turned off" or "whether or not the motor-driven pump 12 has been turned off".

If the determination is affirmative at step S804, the routine proceeds to step S805, and if negative, it ends the present routine for the moment.

At step S805, the ECU 22 determines whether the water flow flag is "ON" or not. If the determination is affirmative, the routine proceeds to step S806 since the water coolant has been introduced into at least the heat accumulator 10. Then, the ECU 22 determines whether or not the amount of the water coolant, which has been introduced into the heat accumulator 10, is sufficient at step S806. If the determination at step S805 is negative, on the other hand, the ECU 22 ends the present routine without determining the state of the water coolant temperature in the heat accumulator 10 since the water coolant has not been introduced into the heat accumulator 10.

At step S806, the water coolant temperature THWt in the heat accumulator 10 is measured. The ECU 22 stores the output signals from the in-heat accumulator water coolant temperature sensor 28 in the RAM 353.

At step S807, the ECU 22 determines whether or not the in-heat accumulator water coolant temperature THWt is higher than a predetermined value. If the water coolant temperature in the heat accumulator 10 has not risen to a temperature under which the effect of supplying heat can be achieved, the water coolant needs to be heated by the heater 32. However, if the heater 32 heats the water coolant for a long time, it needs a larger amount of electricity than the usable electricity which the battery 30 has been charged with. In this case, heating the water coolant by the heater 32 is prohibited.

The predetermined value may be determined according to the amount of electricity which the battery 30 has been charged with. In this case, a relation between the water coolant temperature in the heat accumulator 10 and the amount of electricity necessary for heating the water coolant is calculated, and it is stored in the ROM 352 as a map. Then the amount of electricity which the battery 30 has been charged with is detected, and the predetermined value, as a temperature, is derived by substituting the detected amount of electricity in the map.

If the determination is affirmative at step S807, the routine proceeds to step S808, and if negative, it proceeds to step S811.

At step S807, the ECU 22 determines that the engine 1 has been running for long enough to store a high-temperature water coolant in the heat accumulator 10 (hereinafter referred to as "normal trip"). In this case, the ECU 22 has introduced the water coolant into the heat accumulator 10 for a long time, which indicates that the high-temperature water coolant has been accumulated in the heat accumulator 10. Therefore, electric power which the heater 32 consumes to keep the water coolant temperature necessary for starting the engine 1 next time is small. At step S808, a short trip flag, which indicates that the engine 1 has not been running for long enough to store the high-temperature water coolant in the heat accumulator 10 (hereinafter referred to as "short trip"), is turned off.

At step S809, the ECU 22 permits energizing of the heater 32.

At step S810, determination similar to the one in any of the other embodiments described above is carried out.

At step S811, the ECU 22 determines that the engine 1 has not been running for long enough to store a high-temperature water coolant in the heat accumulator 10, and turns on the short trip flag. In this case, the ECU 22 has not introduced the water coolant into the heat accumulator 10 for a long time, so that the temperature of the water coolant accumulated in the heat accumulator 10 is low. Therefore, the heater 32 consumes a lot of electric power to heat the water coolant to the temperature necessary for starting the engine 1 next time, so that the battery may run out.

At step S812, the ECU 22 prohibits energizing of the heater 32. At this time, the ECU 22 shuts off a circuit to which the heater 32 is connected.

At step S813, the ECU 22 prohibits the failure determination. If the ECU 22 determines the short trip, it indicates that the water coolant temperature in the heat accumulator 10 is low. Furthermore, heating the water coolant by the heater 32 is prohibited at step S812, so that the failure determination is prohibited since a wrong determination may be carried out.

The heater 32 used in the present embodiment, as described above, is capable of controlling its temperature independently. In other words, heating is carried out when needed without a temperature control carried out by the ECU 22. Therefore, when a low-temperature water coolant has been accumulated in the heat accumulator 10, the heater 32 heats the water coolant.

However, if electric power consumption of the heater 32 to heat the water coolant to a predetermined temperature is less than the amount of electricity which the battery 30 is charged with, the heater 32 heats the water coolant until the battery 30 runs out.

In the present embodiment, the water coolant is heated in consideration of the temperature of the water coolant accumulated in the heat accumulator 10 to avoid the problem described above. Therefore, start performance does not deteriorate, and the battery can be prevented from running out.

In the present embodiment described above, the heater 32 can heat the water coolant to the extent where there is no chance that the battery may run out.

In the engine with the heat accumulating device relating to the present embodiment as described above, an abnormality in the heat accumulating device can be detected, even when the temperature of the cooling medium is low.

In the illustrated embodiment, the apparatus is controlled by the controller (e.g., the electronic control unit 22), which is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to exemplary embodiments thereof, it is to be understood that the invention is not limited to the disclosed embodiments or constructions. To the contrary, the invention is intended to cover various modifications and equivalent arrangements. In addition, while the various elements of the embodiments are shown in various combinations and configurations, which are exemplary, other combinations and configurations, including more, less or a single element, are also within the spirit and scope of the invention.

What is claimed is:

1. An engine system including an internal combustion engine and a heat accumulating device, the system comprising:

a heat accumulator that accumulates heat by storing a heated cooling medium;

a heat supplying device that supplies the cooling medium accumulated in the heat accumulator to the internal combustion engine;

a cooling medium temperature detector that measures the temperature of the cooling medium; and a controller that determines a failure of the heat accumulating device based upon a variation of a value measured by the cooling medium temperature detector when the heat is being supplied by the heat supplying device.

2. The internal combustion engine system according to claim 1, wherein:

the cooling medium temperature detector measures the temperature in the heat accumulator, and the controller determines that there is a failure when the measured temperature of the cooling medium in the heat accumulator remains approximately constant over time.

3. The internal combustion engine system according to claim 1, wherein:

the cooling medium temperature detector measures the temperature in the internal combustion engine, and the controller determines that there is a failure when the measured temperature of the cooling medium in the internal combustion engine remains approximately constant over time.

4. The internal combustion engine system according to claim 1, wherein:

the cooling medium temperature detector measures the temperatures in the heat accumulator and in the internal combustion engine, and the controller determines that there is a failure if a difference between the measured temperature in the heat accumulator and the measured temperature in the internal combustion engine is approximately constant over time.

5. An engine system including an internal combustion engine and a heat accumulating device, the system comprising:

a heat accumulator that accumulates heat by storing a heated cooling medium;

a heat supplying device that supplies the cooling medium accumulated in the heat accumulator to the internal combustion engine;

an in-heat accumulator temperature detector that measures the temperature of the cooling medium in the heat accumulator;

an in-internal combustion engine temperature detector that measures the temperature of the cooling medium in the internal combustion engine; and a controller that determines a failure of the heat accumulating device based upon whether there is a difference between a value measured by the in-heat accumulator temperature detector and a value measured by the in-internal combustion engine temperature detector when the heat is being supplied or before the heat is supplied by the heat supplying device.

6. The internal combustion engine system according to claim 5, wherein:

the controller determines that there is a failure if there is a difference between the value measured by the in-heat accumulator temperature detector and the value measured by the in-internal combustion engine temperature detector when the heat is being supplied by the heat supplying device.

7. The internal combustion engine system according to claim 6, wherein:

the controller determines that there is a failure if the difference between the value measured by the in-heat accumulator temperature detector and the value measured by the in-internal combustion engine temperature detector is equal to or higher than a predetermined value when the heat is being supplied by the heat supplying device.

8. The internal combustion engine system according to claim 5, wherein:

the controller determines that there is a failure if the value measured by the in-heat accumulator temperature detector is equal to or lower than the value measured by the in-internal combustion engine temperature detector before the heat is supplied by the heat supplying device.

9. An engine system including an internal combustion engine and a heat accumulating device, the system comprising:

a heat accumulator that accumulates heat by storing a heated cooling medium;

a heat supplying device that supplies the cooling medium accumulated in the heat accumulator to the internal combustion engine;

an in-heat accumulator temperature detector that measures the temperature of the cooling medium in the heat accumulator;

an in-internal combustion engine temperature detector that measures the temperature of the cooling medium in the internal combustion engine; and a controller that determines a failure of the heat accumulating device based upon a difference between a value measured by the in-heat accumulator temperature detector and a value measured by the in-internal combustion engine temperature detector when a predetermined time elapses after the engine is turned off.

10. The internal combustion engine system according to claim 9, wherein:

the controller determines that there is a failure if the difference between the value measured by the in-heat accumulator temperature detector and the value measured by the in-internal combustion engine temperature detector is equal to or lower than a predetermined value when the predetermined time elapses after the engine is turned off.

11. An engine system including an internal combustion engine and a heat accumulating device, the system comprising:

a heat accumulator that accumulates heat by storing a heated cooling medium;

a heat supplying device that supplies the cooling medium accumulated in the heat accumulator to the internal combustion engine;

a cooling medium heater that automatically heats the cooling medium in the heat accumulator to keep the temperature of the cooling medium equal to or higher than a predetermined temperature; and a controller that determines a failure of the heat accumulating device based upon a driving history of the cooling medium heater when a predetermined time elapses after the engine is turned off.

12. The internal combustion engine system according to claim 11, wherein:

the controller determines that there is a failure if the cooling medium heater has consumed electric power equal to or larger than a predetermined quantity before the predetermined time elapses after the engine is turned off.

13. The internal combustion engine system according to claim 11, wherein:

the controller determines that there is a failure if a time used to energize the cooling medium heater is equal to or longer than a predetermined time before the predetermined time elapses after the engine is turned off.

14. The internal combustion engine system according to claim 11, wherein:

the controller determines that there is a failure if the cooling medium heater is activated before the time when the predetermined time elapses after the engine is turned off.

15. The internal combustion engine system according to claim 11, wherein:

the internal combustion engine includes an outside temperature detector that measures the temperature of ambient air, and the controller carries out the failure determination process based upon a measuring result by the outside temperature detector.

16. The internal combustion engine system according to claim 11, wherein:

activation of the cooling medium heater and performance of the failure determination are prohibited if the internal combustion engine is started after the heat supply by the heat supplying device and the internal combustion engine is turned off before completion of warming up of the internal combustion engine.

17. An engine system including an internal combustion engine and a heat accumulating device, the system comprising:

a heat accumulator that accumulates heat by storing a heated cooling medium;

a heat supplying device that supplies the cooling medium accumulated in the heat accumulator to the internal combustion engine;

a cooling medium heater that automatically heats the cooling medium in the heat accumulator to keep the temperature of the cooling medium equal to or higher than a predetermined temperature;

an in-heat accumulator temperature detector that measures the temperature of the cooling medium in the heat accumulator; and a controller that determines a failure of the heat accumulating device based upon a measuring result obtained by the in-heat accumulator temperature detector when a predetermined time elapses after the engine is turned off.

18. The internal combustion engine system according to claim 17, wherein:

the controller determines that there is a failure if the temperature measured by the in-heat accumulator temperature detector is equal to or lower than a predetermined value when the predetermined time elapses after the engine is turned off.

19. The internal combustion engine system according to claim 17, wherein:

the internal combustion engine includes an outside temperature detector that measures the temperature of ambient air, and the controller carries out the failure determination process based upon a measuring result obtained by the outside temperature detector.

20. The internal combustion engine system according to claim 17, wherein:

activation of the cooling medium heater and performance of the failure determination are prohibited if the internal combustion engine is started after the heat supply by the heat supplying device and the internal combustion engine is turned off before completion of warming up of the internal combustion engine.

21. A method of controlling an engine system that includes an internal combustion engine and a heat accumulating device, the method comprising:

accumulating heat by storing a heated cooling medium in a heat accumulator;

supplying the cooling medium accumulated in the heat accumulator to the internal combustion engine;

measuring the temperature of the cooling medium; and determining whether a failure of the heat accumulating device has occurred based upon a variation of the measured temperature of the cooling medium when the heat is being supplied from the heat accumulator.

22. The method according to claim 21, wherein:

the measuring step includes measuring the temperature of the cooling medium in the heat accumulator, and the determining step includes determining that there is a failure when the measured temperature of the cooling medium in the heat accumulator remains approximately constant over time.

23. The method according to claim 21, wherein:

the measuring step includes measuring the temperature of the cooling medium in the internal combustion engine, and the determining step includes determining that there is a failure when the measured temperature of the cooling medium in the internal combustion engine remains approximately constant over time.

24. The method according to claim 21, wherein:

the measuring step includes measuring the temperature of the cooling medium in the heat accumulator and in the internal combustion engine, and the determining step includes determining that there is a failure if a difference between the measured temperature in the heat accumulator and the measured temperature in the internal combustion engine is approximately constant over time.

25. A method of controlling an engine system that includes an internal combustion engine and a heat accumulating device, the method comprising:

accumulating heat by storing a heated cooling medium in a heat accumulator;

supplying the cooling medium accumulated in the heat accumulator to the internal combustion engine;

measuring the temperature of the cooling medium in the heat accumulator;

measuring the temperature of the cooling medium in the internal combustion engine; and determining whether a failure of the heat accumulating device has occurred based upon whether there is a difference between the measured temperature of the cooling medium in the heat accumulator and the measured temperature of the cooling medium in the internal combustion engine when the heat is being supplied or before the heat is supplied by the heat supplying device.

26. The method according to claim 25, wherein:

the determining step includes determining that there is a failure if there is a difference between the temperature measured in the heat accumulator and the temperature measured in the internal combustion engine when the heat is being supplied by the heat supplying device.

27. The method according to claim 26, wherein:

the determining step includes determining that there is a failure if the difference between the temperature measured in the heat accumulator and the temperature measured in the internal combustion engine is equal to or higher than a predetermined value when the heat is being supplied by the heat supplying device.

28. The method according to claim 25, wherein:

the determining step includes determining that there is a failure if the temperature measured in the heat accumulator is equal to or lower than the temperature measured in the internal combustion engine before the heat is supplied by the heat supplying device.

29. A method of controlling an engine system including an internal combustion engine and a heat accumulating device, the method comprising:

accumulating heat by storing a heated cooling medium in a heat accumulator;

supplying the cooling medium accumulated in the heat accumulator to the internal combustion engine;

measuring the temperature of the cooling medium in the heat accumulator;

measuring the temperature of the cooling medium in the internal combustion engine; and determining whether a failure of the heat accumulating device has occurred based upon a difference between the temperature measured in the heat accumulator and the temperature measured in the internal combustion engine when a predetermined time elapses after the engine is turned off.

30. The method according to claim 29, wherein:

the determining step includes determining that there is a failure if the difference between the temperature measured in the heat accumulator and the temperature measured in the internal combustion engine is equal to or lower than a predetermined value when the predetermined time elapses after the engine is turned off.

31. A method of controlling an engine system including an internal combustion engine and a heat accumulating device, the method comprising:

accumulating heat by storing a heated cooling medium in a heat accumulator;

supplying the cooling medium accumulated in the heat accumulator to the internal combustion engine;

automatically heating the cooling medium in the heat accumulator with a heater to keep the temperature of the cooling medium equal to or higher than a predetermined temperature; and determining whether a failure of the heat accumulating device has occurred based upon a driving history of the heater when a predetermined time elapses after the engine is turned off.

32. The method according to claim 31, wherein:

the determining step includes determining that there is a failure if the heater has consumed electric power equal to or larger than a predetermined quantity before the predetermined time elapses after the engine is turned off.

33. The method according to claim 31, wherein:

the determining step includes determining that there is a failure if a time used to energize the heater is equal to or longer than a predetermined time before the predetermined time elapses after the engine is turned off.

34. The method according to claim 31, wherein:

the determining step includes determining that there is a failure if the heater is activated before the time when the predetermined time elapses after the engine is turned off.

35. The method according to claim 31, wherein:

the internal combustion engine includes an outside temperature detector that measures the temperature of ambient air, and the determining step carries out the failure determination process based upon a measuring result by the outside temperature detector.

36. The method according to claim 31, wherein:

activation of the heater and performance of the determining step are prohibited if the internal combustion engine is started after the heat supply by the heat supplying device and the internal combustion engine is turned off before completion of warming up of the internal combustion engine.

37. A method of controlling an engine system including an internal combustion engine and a heat accumulating device, the method comprising:

accumulating heat by storing a heated cooling medium in a heat accumulator;

supplying the cooling medium accumulated in the heat accumulator to the internal combustion engine;

automatically heating the cooling medium in the heat accumulator with a heater to keep the temperature of the cooling medium equal to or higher than a predetermined temperature;

measuring the temperature of the cooling medium in the heat accumulator; and determining whether a failure of the heat accumulating device has occurred based upon the temperature in the heat accumulator when a predetermined time elapses after the engine is turned off.

38. The method according to claim 37, wherein:

the determining step includes determining that there is a failure if the temperature in the heat accumulator is equal to or lower than a predetermined value when the predetermined time elapses after the engine is turned off.

39. The method according to claim 37, wherein:

the internal combustion engine includes an outside temperature detector that measures the temperature of ambient air, and the determining step carries out the failure determination process based upon a measuring result obtained by the outside temperature detector.

40. The method according to claim 37, wherein:

activation of the heater and performance of the determining step are prohibited if the internal combustion engine is started after the heat supply by the heat supplying device and the internal combustion engine is turned off before completion of warming up of the internal combustion engine.

* * * * *